United States Patent [19]

Abate

[11] 4,128,975

[45] Dec. 12, 1978

[54] PREFABRICATED BUILDING COMPONENTS OF EXPANDED MATERIAL AND CEMENT

[75] Inventor: Giorgio Abate, Modena, Italy

[73] Assignee: Solai Vignola di Fabiani Orlando e C. - Societa in nome collettivo, Ancona, Italy

[21] Appl. No.: 720,749

[22] Filed: Sep. 7, 1976

[30] Foreign Application Priority Data

| | | | |
|---|---|---|---|
| Sep. 5, 1975 | [IT] | Italy | 40085 A/75 |
| Dec. 18, 1975 | [IT] | Italy | 40132 A/75 |
| Dec. 18, 1975 | [IT] | Italy | 40133 A/75 |
| Apr. 8, 1976 | [IT] | Italy | 40057 A/76 |

[51] Int. Cl.[2] ..... E04G 21/00; E04B 5/19

[52] U.S. Cl. ..... 52/125; 52/309.4; 52/309.7; 52/324; 52/440; 52/577

[58] Field of Search ..... 52/309.4, 309.7, 322, 52/324, 440, 332, 577, 320, 321, 325, 125

[56] References Cited

U.S. PATENT DOCUMENTS

| | | | |
|---|---|---|---|
| 1,163,187 | 12/1915 | Waite | 52/125 X |
| 1,229,904 | 6/1917 | Day | 52/440 X |
| 1,660,370 | 2/1928 | Billner | 52/440 |
| 2,260,425 | 10/1941 | Widmayer | 52/324 |
| 3,247,294 | 4/1966 | Sabouni | 52/309.12 |
| 3,598,672 | 8/1971 | Heller | 52/323 X |
| 3,999,341 | 12/1976 | Stout | 52/577 X |

FOREIGN PATENT DOCUMENTS

| | | | |
|---|---|---|---|
| 826584 | 11/1969 | Canada | 52/309.4 |
| 1180927 | 1/1959 | France. | |
| 1207134 | 8/1959 | France | 52/440 |
| 1269709 | 7/1961 | France. | |
| 2054804 | 4/1971 | France | 52/309.4 |
| 706855 | 5/1966 | Italy | 52/322 |
| 315812 | 9/1956 | Switzerland | 52/324 |
| 357532 | 11/1961 | Switzerland | 52/324 |
| 505958 | 5/1971 | Switzerland. | |
| 884553 | 12/1961 | United Kingdom | 52/692 |

OTHER PUBLICATIONS

Architectural Record, Mar., 1969, pp. 175, 176.

*Primary Examiner*—Alfred C. Perham
*Attorney, Agent, or Firm*—Browdy and Neimark

[57] ABSTRACT

Prefabricated building components such as panels, roofing units, and floor blocks and a method and machinery for producing the same. The prefabricated components are obtained by casting in form a mix containing granules of expanded polystyrene or other suitable light thermal and sound insulating material which is bonded to cement by adhesive. Depending upon their particular application, the components may be used for either load bearing or non-load bearing purposes.

6 Claims, 35 Drawing Figures

PREFABRICATED BUILDING COMPONENTS OF EXPANDED MATERIAL AND CEMENT

FIELD OF THE INVENTION

This invention relates to prefabricated building components of expanded material and cement, the prefabrication method and the relative machinery. The end products of the present invention are prefabricated components such as panels, roofing units and floor blocks for load bearing or non-load bearing floors, roofs and walls, consisting mainly of a casting, for example of expanded polystyrene, water and cement treated chemically with adhesive substances, forming a homogeneous mix in which the granules of expanded polystyrene or of other suitable light material adhere to the cement to form a structure which interrupts sound propagation. The products obtained with this mix, besides being light and insulating, are resistant to fire, and to chemical and atmospheric agents. Moreover, these products have considerable mechanical strength, and in contrast to traditionally used materials do not degrade with time. Some of said prefabricated components are of shape suitable for a new method of production using new types of machines.

BACKGROUND OF THE INVENTION

The prior art is distinguished by prefabricated components of reinforced concrete and hollow bricks, sometimes lightened with expanded clay, these materials being moderately insulating but used only for non-load bearing prefabricated components. There has also been some attempt to use expanded polystyrene in parallelepiped blocks inserted into cavities in reinforced concrete structures. This prior art presents certain deficiencies and disadvantages deriving from the fact that prefabricated components of reinforced concrete and hollow bricks, besides being very heavy are not insulating, and propagate sound and therefore noises. Moreover, the use of simple or reinforced hollow bricks is very costly because of the labor required, transportation and rejects, without considering the fact that hollow bricks in contact with reinforcing rods transmit humidity thereto, so causing corrosion. With regard to the use of expanded clay, this tends to swell with humidity, giving rise to deformation of the manufactured components. Furthermore, it is not very light and is not suitable for bonding with small quantities of cement. With regard to the use of expanded polystyrene in filling cavities, it has no effect, or indeed a negative effect on lightness, and its use against heat and sound transmission is of minimum effect. Furthermore, this material is not suitable for working on building sites as it easily deforms and crumbles.

SUMMARY OF THE INVENTION

These deficiencies and disadvantages lead to the need to resolve the new technical problem of conceiving load bearing or non-load bearing prefabricated components consisting of castings, which prevent sound transmission, which are insulating, light, fire resistant, non-degrading and require minimum labor in manufacture, with minimum formation of wastage, and which can be lifted from their forms after short curing periods so as to accelerate production and more rapidly amortize the installation. These prefabricated components must be easily workable on site to allow the execution through them of holes, slots or recesses for housing and/or the passage of system elements for the building. In particular it is required to find a manufacturing method to continuously produce the prefabricated components at more convenient speeds and costs than those obtainable up to the present time in the case of traditional prefabricated components.

The manufacturing method in accordance with the present invention is to be carried out by machines which also form a particular object of the new technical problem. The present invention completely resolves the aforesaid new technical problem in four stages, represented in the four Italian priority patent applications. In the first patent application, 40085 A/75 of Sept. 5, 1975, a prefabricated panel is used consisting of a casting from a mix containing expanded polystyrene granules bonded to cement by adhesive. The prefabricated component consists mainly of two longitudinal lateral members separated by a channel, and connected together lowerly by a base slab in a single piece with said members, and is particularly suitable for preventing noise and heat transmission. In the channel there is inserted during prefabrication a trellis reinforcement, the stirrups of which are lowerly and laterally extended to enter the casting and enable the prefabricated component to be lifted after short curing, and to keep said longitudinal members joined together at the thin base slab. Concrete is cast into said channel during site erection to form an integrated unit with the overlying slab, which is also of concrete. On the outsides of said two longitudinal members there are provided recesses to form a further channel, when two equal prefabricated components are placed together, to receive concrete during casting on site erection, to make the entire assembly monolithic and prevent gaps. In each of said longitudinal members there are provided inserts in expanded polystyrene, to obtain an assembly in which, in particular, the metal reinforcements are protected against corrosion.

In the first patent application, no new method of prefabrication is included, nor any new machinery suitable for providing such a method.

In the second patent application 40132 A/75 of Dec. 18, 1975, the prefabricated component of the first patent application, besides having an external lateral profile which is more advantageous for fixing and stability, is made stronger by formation during prefabrication of a concrete slab at the bottom of the channel between two said longitudinal members. This slab incorporates the two lower longitudinal rods of the trellis reinforcement and is laterally inserted by undercutting into the bottom of the lateral walls of said channel. The prefabricated component is provided with longitudinal lightening holes. Prefabricated components such as roofing units, floor blocks and beams are proposed, and are manufactured with the same mix. The second patent application includes a new continuous forming method consisting of ploughing the casting mass, cast into a special form of any desired length, by a longitudinal hull to allow reinforcement channels and longitudinal lightening holes, if necessary, to be formed in said mass. The machine of this method consists of a motorized carriage rolling on the reclinable sides of the form, and is lowerly provided with a hull of one or two bodies to create the central channel and, if required, is also provided with lateral holes in the prefabricated component. Also included are compactors, smoothers and height limiters for the prefabricated component. The carriage is provided at its front with a hopper for introducing the mix to form the main casting and at its rear with a hopper for casting said concrete slab before introducing the reinforcing trellis into said channel. The trellis is situated on an auxiliary carriage dragged by the hull carriage. To the rear of said hopper there is hinged one or more backwardly inclined shelves adjustable in height to determine the height of the casting, to compact it and smooth it. In one modification of the machine, instead of connecting the motor to the hull carriage, the motor is connected to an impeller of transverse horizontal axis installed in the outlet port of the front hopper to thrust the mix backwards with its blades, so that the hull carriage advances by reaction. In further modifications, by supporting from said sides other lateral form profiles inserted inside them, narrower manufactured components are obtained of different lateral profiles. The machine of the second patent application enables mass production to be obtained and at the same time is also convenient for the artisan.

In the third patent application 40133 A/75 deposited simultaneously with the second on Dec. 18, 1975, instead of a mobile hull there is a fixed hull extractable vertically or longitudinally, while the front hopper with the smoothing, compacting and height limiting elements for the prefabricated component remains mobile. In the third application, there is no rear hopper. The machine of this third application is much less rapid than that of the second application, but is still valid for certain artesan applications.

In the fourth patent application 40057 A/76 of Apr. 8, 1976, modifications are made in particular to the machine of the second application, these consisting mainly of the elimination of the form sides in their particular configuration as a support for the hull carriage over the entire length of the hull stroke, replacing them by a pair of short shaped sides supported laterally on said carriage; improving the delivery mouth of the two hoppers and improving the adjustment and operation of the smoothing, compacting and height limiting elements; using flat hulls for large width components; adapting the machinery to the formation of elements for dividing walls or partitions; and using a conveyor belt as the form base for fixing to the reaction machine in order to avoid carriage motion and thus make it operate as a type of fixed extruder, in particular for the mass production of boards and dividing walls.

BRIEF DESCRIPTION OF THE DRAWINGS

The prefabricated expanded polystyrene-cement components, the machines for their prefabrication and their main modifications, to be used according to the case under consideration, are shown by way of example in the 22 accompanying sheets of diagrammatic drawings, in which:

FIG. 20 is a longitudinal section regarding a modification of part of the plant of FIG. 6 relative to said shaped closing form, in the case of manufacture of hollow or solid flat blocks for floor slabs and roofs with reinforced concrete beams of double T section, or hollow or solid dividing panels or the like;

DETAILED DESCRIPTION OF PREFERRED EMBODIMENTS

Figures 1, 2, 3:
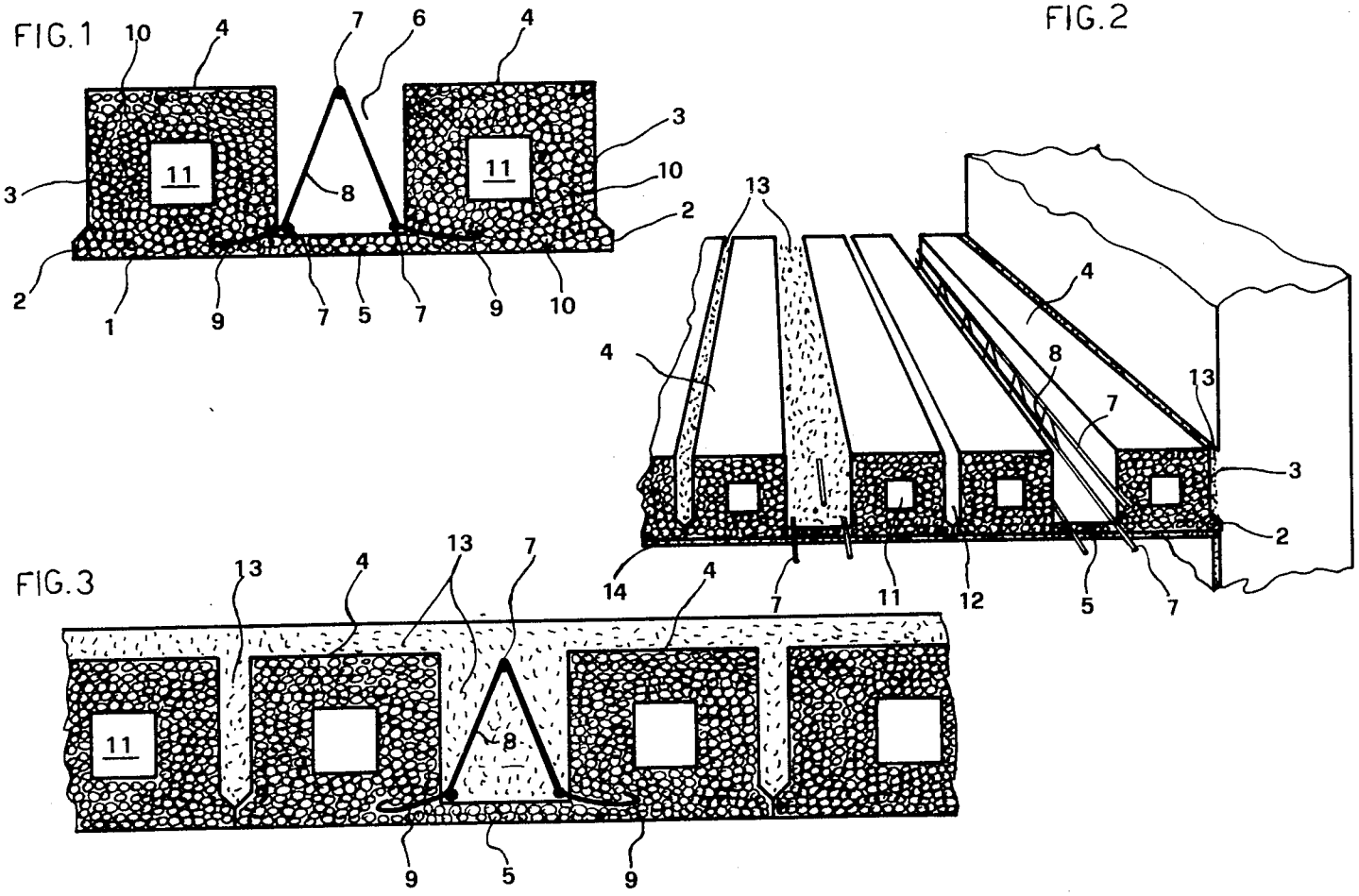
FIG. 1 is a cross-section through a two member panel obtained by casting, with the stirrup appendices of the trellis reinforcement inserted.
FIG. 2 is a perspective view of a number of assembled adjacent panels during casting of the concrete.
FIG. 3 is a cross-section through a portion of completed slab.

FIGS. 1-3, relating to first said priority application, show the base of the panel casting 1, sufficiently smooth for dispensing with plastering if required, the projections 2 on the withdrawn sides 3 of the two longitudinal members 4 joined at the bottom by the slab 5, a longitudinal compartment or channel 6 into which is inserted the reinforcement 7 provided with stirrups 8 and appendices 9 penetrating into the casting to help prevent bending during manipulation and the need to prop during erection. The expanded polystyrene granules 10 are treated chemically with adhesives for adhering to the cement. The longitudinal expanded polystyrene elements 11 are inserted into the panel. A longitudinal compartment 12 is provided for receiving the concrete cast on site to give stability and strength and prevent any gaps and deformation. The concrete 13 is cast on site in the channel 6 to incorporate reinforcement and stirrups 7-8 and to form the slab on the longitudinally extending upstanding ribs 4. The possible plaster 14 is also shown.

FIGS. 4-21, relating to said second priority application, show the frame 15 of a carriage provided with wheels 16 rolling on a pair of upper longitudinal elements 17 each forming the upper outer rim of a side 18 of a form containing the casting 19 consisting of the paste mix of cement and expanded polystyrene in granules, the pair of longitudinal elements 17 extending to form a mobile arrival and departure station for said frame, not shown. A hopper 20 is installed on 15 and supplied with cement and expanded polystyrene mix. A vibrator 21 is fixed to 20 for the rapid constant delivery by gravity of said mix. A hopper 22 is fixed to 15 for delivery of the concrete to form a base slab 23 for fixing the reinforcing rods and is provided with a rear wall, not shown, projecting lowerly to give levelling of the layer. A baseplate 24 of the form for the casting 19 is supported on both sides by the members 15 of the base 26 of the plant. The body 27 of a central longitudinal box or mobile hull, installed over the center line of the space between the sides 19 and baseplate 24, is raised relative thereto, and is suspended on both sides by brackets 28 from the frame 15. A front penetration head 29 of 27 is provided with a triangular face 30 for compacting downwards. A pair of longitudinal cylindrical elements 31 is suspended from 20 by brackets 32 to form a pair of longitudinal through holes for lightening and fixing the body of the casting 19. A shaped closure box 33 is inserted between 18 and 24, its end faces 34 and 35 forming respectively the limit of the casting 19 and the limit of another equal casting cast in that part of the plant symmetrical to 33. A possible pair of cone frustum projections 36 and 37, on 34 and 35 respectively, is inserted in corresponding holes of 34 and 35 and bayonet coupled by rotation into respective sleeves 38 and 39 fixed to the inside of 34, 35, said cone frustum projections being installed as an alternative to the cylindrical elements 31 to create in casting 19 end cavities for fixing the casting to the support structures of the building. An inclined compacting shelf 40 is removably fixed by pins 41 and 42 to the sleeve 43 of 20 and the sleeve 44 of 27 respectively. A rib of said inclined shelf is hinge connected by a forked coupling to the screw 45 provided with an operating handwheel 46, coupled to the nut screw 47 fixed to 15 so as to give 40 different positions in height dependent on the height of the section of 27 required for the case considered. A motorized reducer 48 is fixed to frame 15 to move it by acting on the axle 49. A possible auxiliary weight 50 is installed on 15 to prevent any tendency for 15 to lift under the action of the casting 19 on the surfaces 30, 40 etc.. A front containing wall 51 is for the casting leaving 20. Elements 52 are reclinable about transverse hinges 53 connected to base 26, their upper ends being fixed into corresponding clamps 54 in the elements 55 reclinable about longitudinal hinges 56 fixed to 25, connected to 18, 17. A pair of wheels 57 each supported by a sleeve 58 are slidable on 59 and supported by a spring 60 to form a resilient reaction to the lifting of the wheels 16 of frame 15. A pair of lateral grooves 61 are provided in closure box 33, each of U section open upwards, in the case of use of the cylindrical elements 31, for their passage through 33 during motion of 15. A central groove 62 is provided in 33, of U section open upwards, for the passage of the body 27 during its linear movement. A pair of triangular sections 63, fixed to baseplate 24 to give base bevels to the body of the slab element, are provided in order to allow the elements 19 to be coupled even on surfaces which are not completely flat and to allow passage of electric cables. Longitudinal tubular stiffening elements 64 are provided for 18-17-55, and arms 65 for turning 52 about 53; longitudinal projections 66 and 67 are provided on the sides 19 to form grooves on the sides of 20 for better adherence in coupling the floor slab elements together and to prevent gaps and recesses 68 are provided in 18 to provide projections on 19 for creating interspaces between neighboring slab elements to receive a concrete casting for improving adherence between the elements and prevent crumbling, and also limiting heat transmission in the base of said elements. A pair of triangular faces 69 of box or hull 27 is provided for lateral and downward compacting of the casting 19. A pair of connected enlargements 70 on box or hull 27 and triangular face 30 is provided for obtaining a base enlargement in the casting 19 of the cavity determined by 27 for housing therein the concrete from 22 and embedding the relative longitudinal rods and possible lateral extensions of the reinforcing stirrups. A rear carriage 71 is drawn by 14 by way of the coupling 72, on the upper surface 73 of which there being laid the set of trellis reinforcements all ready for depositing inside the casting 19 in the bed 23 of concrete, the three longitudinal reinforcing rods being indicated by 74, 75, 76 and the inverted V stirrups by 77, and provided with possible convenient lateral base projections 78. The sides 79 are for containing said set of reinforcements, of which only one element is shown. An inclined central compacting shelf 80 is as wide as the underlying hull or box, and is fixed at the rear to the hinge pin 81 rotatably supported on the lugs 82 of the hopper 20. A sleeve 83 is coupled externally to 81, and is provided with an aperture 84 in its central front part for enabling it to rotate about 81. A pin 85 is provided for inserting into the lugs 86 on the hull and into the end sleeve 87 of 80 to fix 80 to the underlying said hull. A pair of compacting, smoothing and height limiting blades 88 is fixed to 83 and is provided with ribs 89 on one of which is hinged the lower end of an operating screw 90, the nut screw 91 of which is fixed to the frame 15. The screw 90 is provided with an operating handwheel 92. The body 93 of the relative hull, is analogous to that indicated by 27 in FIG. 4. A shaft 94 is driven by a motor replacing the motor 48, or driven by cranks 95, and is provided with a pair of blades 96 and 97 to compact the pasty mixture of polystyrene-cement in the parts 98, 99 of the casting 19. Pairs of shaped elements 100, 101 are provided for agitating the mass of said mixture. Lateral recesses 102, 103 are provided in the casting 19. A base projection 104 in the manufactured component is provided with a bevel 105. A channel 106 is provided in the component 19 for casting the concrete when erected on site in order to obtain the load bearing rib. The concrete 107 is cast on site into 106. The concrete 108 is cast on site into the interspace obtained by the facing parts 102, 103, 109 on bringing the projections 104 of adjacent elements 19 together. A floor slab element or panel 110 in a single block of expanded polystyrene-cement is obtainable by the machine of FIG. 4 when 22, 27, 29 are eliminated. Holes 111 are provided for lightening, for gripping while lifting, and for fixing the casting on site. A completion slab 112 is provided for casting on site. The slab element has a smooth base 113. A lateral inclined face 114 of 111 to enlarges the section of the channel into which concrete 115 is cast on site. Three longitudinal bars 116 are inserted into 115. The completion slab 117 is provided for the casting on site when using 110. A central hole 118 is provided for lightening shaped wall 119 is included in the plant on all sides (FIG. 18) for forming the casting 120 with the expanded polystyrene-cement mixture, provided with holes 120 and 122. The base 123 of expanded polystyrene-cement mixture is part of the load bearing beam. A layer of concrete 124 is part of the same beam. The reinforcing rods 125 are connected by stirrups 126. The casting on site 127 is completed by the slab 128. A crest-shaped plate 129 (FIG. 19) is furnished for simultaneously forming several beams in series in the plant according to the invention. Uprights 130 are provided lowerly with a baseplate 131 for levelling the layer of polystyrene-concrete, and are upperly fixed to the top of the mobile hopper 20 in the absence of 27 and 31, the layer of concrete 124 in the various channels being levelled by the lower edge of a rear upright 132 projecting to an adjustable extent into each channel from the delivery mouth of the hopper 22. The casting 113 (FIG. 20) forms a roofing unit or panel element in expanded polystyrene-cement. Boxes 134 are similar to 33, but are provided at their front with recesses 135. The projections 136 on 133 are created by 135. The casting 133 may have its contour and internal or external shape characteristics similar to 19, 110, 120, all obtainable by the plant according to the invention.

FIGS. 22–27 with respect to said third priority application show the frame 137 of a carriage provided with wheels 138 rolling on a pair of upper longitudinal elements 139 each forming the outer upper square rim of a wall of a form 140 for containing the casting 141 formed from a pasty mixture of cement and expanded polystyrene in granules, with adhesive (as in the case of casting 19 of FIG. 7), said pair of longitudinal elements able to be extended to form a mobile arrival and departure station for said frame, not shown. A baseplate 142 of the form for the casting 141 is supported on two sides by the members 143 of the base 144 of the device. Two opposing walls 145 of a central box or body are each lowerly provided with an enlargement 146 and with upper portions 147 and lower portions 148 bent horizontally. A plate 149 adjustably connecting the bent portions 147 by pins 150 is slidable in cross slots 151. A plate 152 opposite 149 is provided with screws 153 for transverse adjustable connection to the bent portions 148 provided with slots 154. A set of double acting hydraulic cylinders 155 is fixed to a wall 145 for the upward extraction of the hull 145, 146, 147, 148 by drawing the walls 145 towards each other. The ends of the rods 156 of the pistons 155, are fixed to the other wall 145. Recesses 157 and 158 are included. A projection 159 is provided on 140. A strip 160 is fixed to 142 to create a bevel at the base of the manufactured component 141 to prevent cracking or crumbling when making contact with other components. Elements 161 are rotatable about transverse hinges 162 connected to 144, the upper ends of which are fixed into corresponding clamps in the elements 163 rotatable about the longitudinal hinges 164 fixed to 143, connected to 140, 139. A pair of wheels 165, each supported by a sleeve 166, is slidable on 167, and supported by a spring 168 to provide a resilient reaction to the lifting of the wheels 138 of 137. Longitudinal reinforcements 169 of 139 and 140 are provided. Inflatable rubber or plastic cylinders 170, of variable diameter are fixed into the ends of the form 140, 142 to create longitudinal holes in the casting 141. A grip 171 is furnished for turning 161. A hopper 172 for the pasty expanded polystyrene-cement and adhesive mixture is fixed to the mobile frame or carriage 137. An inclined central shelf 173 for compacting 141, slides on 149 and is hinged at 174 to 172. A pair of lateral inclined shelves 175 for compacting, smoothing, levelling and limiting the height of 141 are hinged at 174 to 172, their rear edges sliding over the top surfaces of 141. Two screws 176 and 177 are provided with corresponding operating handwheels 178 and 179, the lower forked ends of which are hinged respectively to a rib on 173 and a cross member which connects the pair of shelves 175 together, said screws being coupled to the respective nut screws 180 and 181 fixed to 141; the box ends 182 of the form 140, 142, are mobile on 142 to obtain various lengths of the component 141. An end 183 of 170 is provided with a valve for the introduction and release of compressed air. Manufactured component 141 is provided with a top surface 184. A liftable bridge 185 rests on 139, from which decend the elements 186 provided lowerly with a section 187 for longitudinally guiding the central body 188 extractable longitudinally or vertically, and provided with a longitudinal T shank 189. The walls and base 190 and 191 respectively comprise the box 188. Hooks 192 are fixed to 185 for fixing the bridge 185 to 139 by lever closing members 193 of known type. The body 188, 189, 190, 191 may be provided at its two ends with a pair of smoothing and levelling blades for the upper surface of the casting 141, operating during longitudinal extraction, done for example by pulling a rope.

FIGS. 28–34, with regard to said fourth priority application show the frame 194 of a carriage provided with wheels 195 rotating on the rail 196 forming part of the base 197 of the plant. A shaft 198 is rotatably supported on a side of 194 and driven by a motor, not shown, to transmit motion through the pinion 199 and side chain 200 to the pinion 201 of the rear wheel 195 situated on the same side, so that of the four wheels 195 only those situated on one side are driven. A tensioning device 202 is provided for the side chain 200. A longitudinal central box or hull 203 is supported on 194 and adjustable in height by means of handwheels 204 keyed onto operating screws 205 lowerly hinged at 206 to 203. Nut screws 207 are fixed to 194 for coupling to 205. Walls 208 of the form, suitably shaped and strengthened according to the case under consideration, and upperly fixed in a removable manner by bolts 209 to the frame 194 of the carriage provided with slots 210, are positionable transversely in an adjustable manner, for example by operating screws. The lower ends of 208 slide on the bottom surface 211 of the form which is fixed to 197. A hopper 212 distributes the mix 213 of cement-expanded polystyrene, or other suitable material, and is fixed to 194. An auxiliary hopper 214 is supported on 212 to form a feed reserve, the existence of this hopper dispensing with the use of auxiliary weights such as 50. A rear baffle 215 is located at the delivery mouth of 212 to prevent clogging of the material against the inclined shelf 216, hinged at the rear with a certain degree of slack to the axle 217, and at the front with a certain degree of slack to the axle 218 supported on a vertical plate 219 fixed to the inner vertical plate 215 by bolts passing through vertical slots in the delivery mouth of 212. A handwheel 220 keyed onto the operating screw 221 is lowerly hinged at 222 to 216. A nut screw 223 is fixed to 194 for couplihg to 221. Lateral compacting shelves 224 are hinged at their front with a certain degree of slack to 217, and at their rear with a certain degree of slack to the axle 225 on which are hinged the lateral compacting-smoothing shelves 226, the rear ends 227 of which determine the height of the casting 228 (of the type of 19 and 141). The uprights 229 of a bridge connect the compacting shelves 224. A handwheel 230, keyed onto the operating screw 231, is lowerly fixed to the cross member 232 of 229. A bridge frame 223 corresponding to 229, 232, is provided with a nut screw 234 for 231, designed to guide the vertical movement of 229, 232 with a certain degree of slack. The uprights 235 of a bridge connect the shelves 226. A handwheel 236 keyed onto the operating screw 237 is lowerly fixed to the cross member 238 of 235. A bridge frame 239 corresponding to 235, 238, provided with a nut screw for coupling to 237, is designed to guide the vertical movement of 235, 238 with a certain degree of slack. A rear hopper 240 is fixed by screws to 194 to distribute the concrete 241 to form the base slab 242 for anchoring the reinforcing rods, not shown. The channel 243 is provided for insertion of the slab 242. A front box appendix 244 for containing the casting is fixed to the delivery mouth of 240. A gate valve 245 is operated by the lever 246 by means of a handwheel and screw-nut screw 247. The vertical sides 248 of the inclined shelf 216, tapered at the rear and positionable, convey the material between the sides 208. A bent portion 249 of 248 is hinged at 250 and 216 for adjusting the angular position. Locking screws 251 are provided for the slack between 229, 233 and 235, 239 after it has been adjusted. Longitudinal cylindrical elements 252 may be suspended from 212 by brackets 253 of adjustable level, to create lightening holes in 228. Inclined shelves 254, 255, 256 of the end of 203 aid penetration and compacting. Lower terminal elements 257 of 208 form bevels in the component. Longitudinal blades 258 (FIG. 33) fixed to the rear of 224, 226 by screw connectors 259 divide the casting 228 into longitudinal strips of predetermined width. Mobile rails 260 supported by uprights 261 are lowerly provided with positionable wheels 262. Mechanical closure clamps 263 of known type, for example of lever type, clamp 260 to 197. Supports 264 (FIG. 34) for the frame 194 of the type indicated in the previous figures lift the wheels 195 from the support surface and thus make the frame 194 fixed. A gearwheel 265 keyed onto the shaft 198 transmits motion through the chain 266 to the gearwheel 267 of the shaft 268 rotatably supported on the bottom of 212, on which are fixed the blades 269 of an impeller designed to convey the mix 213 rearwards to form the casting 228, possibly grooved by cylindrical elements 270 for lightening the manufactured component, supported at the lower rear end of 212 by brackets 271. A link belt 272 is wound on the drums 273, the shafts 274 of which are rotatably supported on a frame 275, one of said shafts being rotated by a motorized reducer, not shown. The upper branch of 272 is designed to support and drag the plates 276 forming the bottom of the form comprising walls 208 cut to the required lengths. A cutting element 277 (blade, wire or the like) is arranged to separate the previous casting from that under formation. A conveyor belt 278 removes the component. Strips of plate 279 are fixed upperly to the edges of 224, 226 to vary the width of the shelves according to the positions of the walls 208. Lower levelling elements 280 are connected to 279 by screws and wing nuts. The sides 248 are made positionable according to the width of 224, 226.

The operation of the plant or machine in the case of said second application (FIG. 4 to FIG. 21) is as follows. To obtain the manufactured component of FIG. 14, the hopper 20 (FIG. 4) is fed continuously with a mixture of light concrete consisting of granules of expanded polystyrene treated chemically with an adhesive substance and mixed with powdered cement, and then made into a paste with water. The mixture falls onto 24 by the action of the vibrator 21, while the motor 48 moves the frame 15 on 17 from left to right. The box or hull 27, 30 advances into the mass of said mixture to distribute the mixture and compress it lowerly and laterally to form the suitably compacted casting 19, which is levelled upperly by the inclined shelf 40. The hopper 22, continuously fed with concrete formed in known manner from sand, cement, water and fine gravel, causes a layer 23 of concrete to flow onto the enlarged floor of the channel 106, its height being defined by a baffle, not shown, fixed to the rear of the outlet mouth of 22.

In the meantime the cylindrical elements 31, in the absence of 36, and rigid with 20, advance with 15 to produce the lateral holes 111 in the mass of 19, while the operator, having taken a metal reinforcement 74, 75, 76, 78, positions it on a reference gauge, not shown, and thrusts it from left to right into the space 23, 106 to the required distance, i.e., until stopped by the face 34 of 33. The grooves produced by 78 in 19, 23 close automatically under the effect of the pressure of the pasty mass. The movement of 15, 20, 22, 27, 30 ceases because of the effect of a limit switch or by the operator controlling the motor 48 when the outlet mouth of 22 passes the vertical plane of the face 34 of 33, while the rear ends of the bodies 27 and 31 have already passed said plane, the delivery by 20 and 22 terminating at the vertical transverse plane of 34. The rapid forming operating thus terminating, the frame 15 and that connected to it stop in an extended portion of the rail 17 which is mobile on wheels in order to move it to different forming lines such as 17.

In the meantime, the expanded polystyrene granules receive the heat of reaction of the cement with the water, and rapidly begin to harden, so giving the casting 19, with the addition of the casting 23 and appendices 78, a sufficient rigidity to be lifted without damaging the component, after at the most a few hours, by a connection at 74. The component is ready for its subsequent use, as its lateral dimensions are defined by the walls 19, 66, 67, 68, 63, its height is defined by the rear edge of 40 and base 24, or by the rear edge of the lateral inclined shelves 89 in the case of FIGS. 10-11, the dimensions of the channel 106 and its base enlargement occupied by 23 are determined by 27, 30, 69, 70, and finally its length is determined at the front end by the face 34 of 33, and at the rear end by the face of a vertical element, not shown. The casting 19 thus obtained is able to form a continuous thermal and acoustic insulation by way of the slab 23 which, when erected, short-circuits the thermal and acoustic conductivity of 23 and 28, said casting also being embedded when erected in a casting of concrete such as 112, 108, which collaborates with 23, 74, 75, 76, 78 to give a load bearing monolithic structure.

Figure 4:
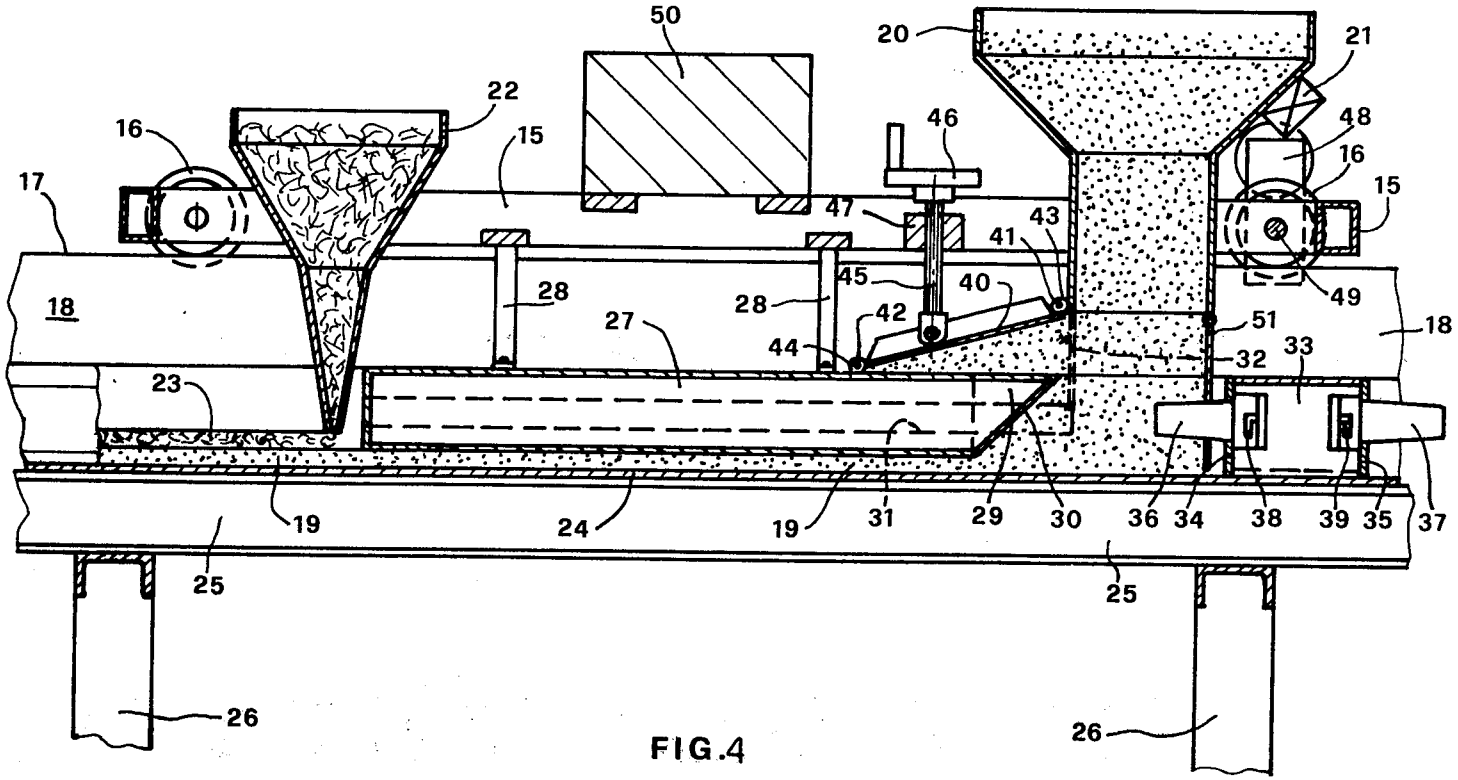
FIG. 4 is a longitudinal partial vertical section through the center line of the plant with the mobile hull.
Figure 5:
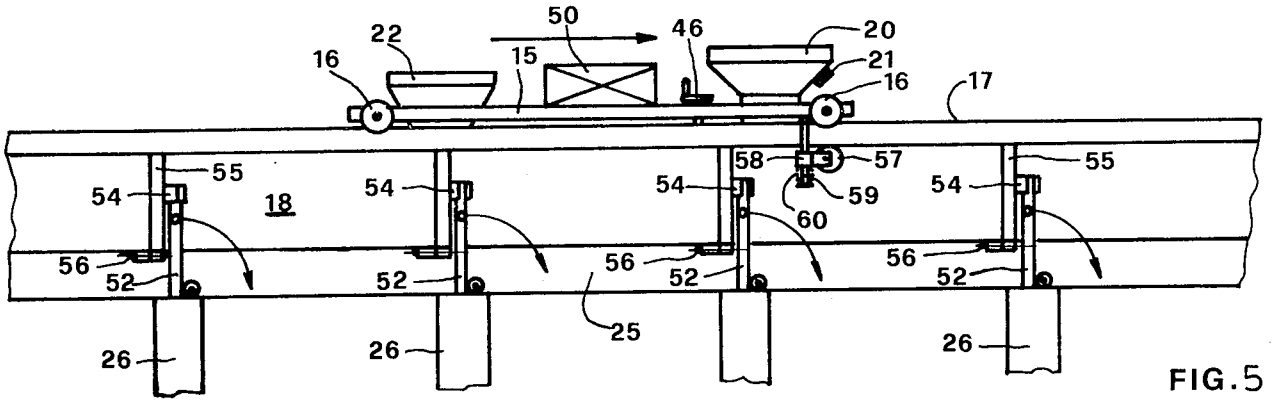
FIG. 5 is a reduced side view of the plant of FIG. 4.
Figure 6:
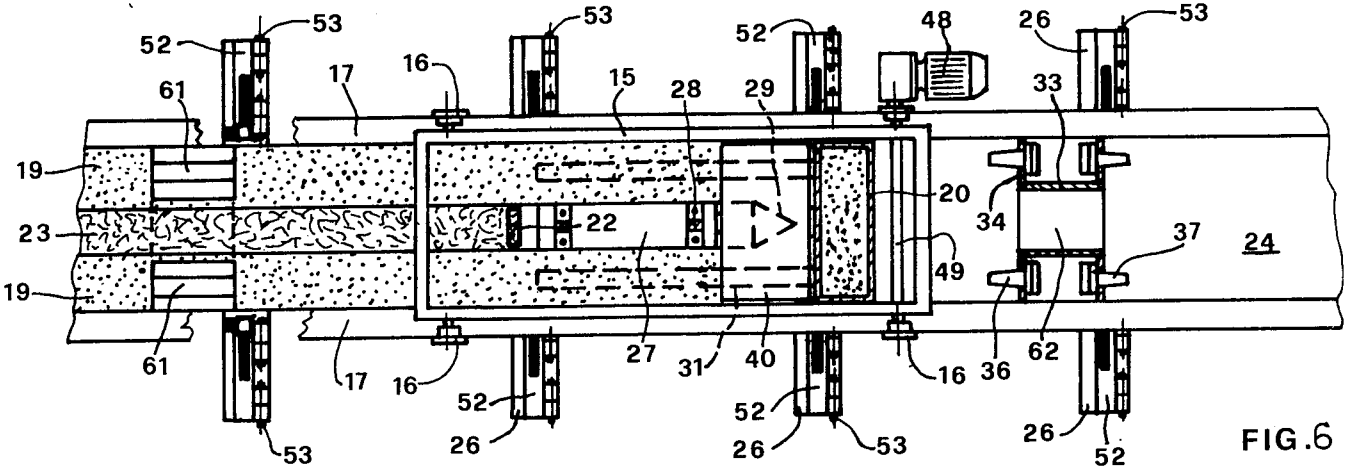
FIG. 6 is a partially sectional plan view of the plant.
Figure 7:
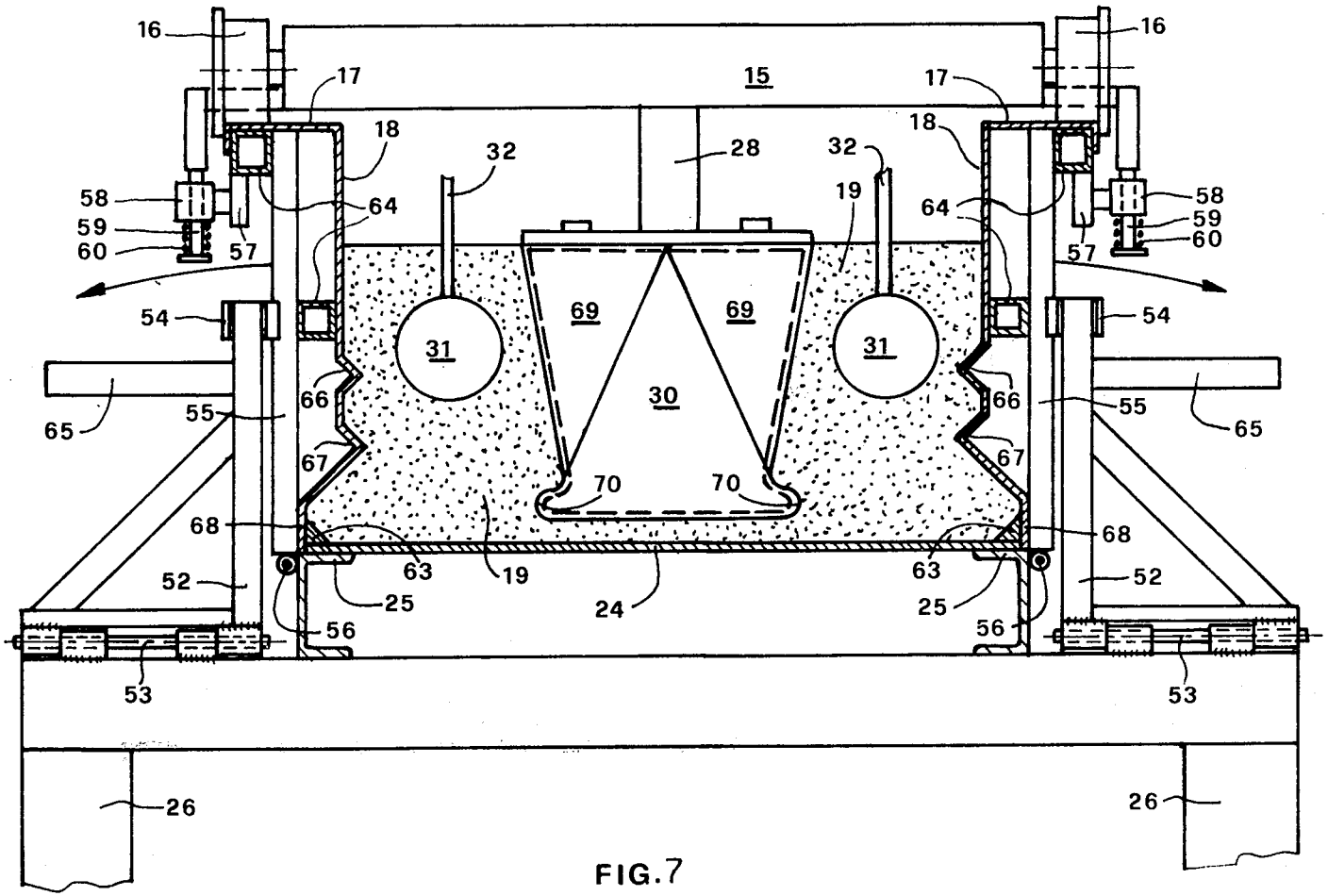
FIG. 7 is an enlarged partial cross-section through the plant.
Figure 8:
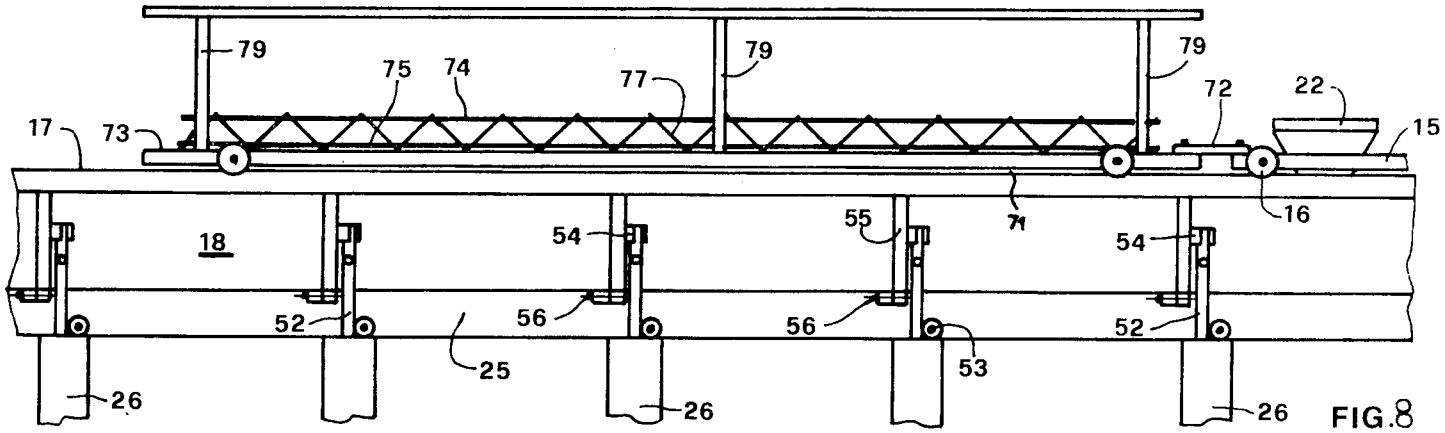
FIG. 8 is a reduced side view of that part of the plant following that of FIG. 5 in the direction of motion, regarding the supply of reinforcing rods.
Figure 9:
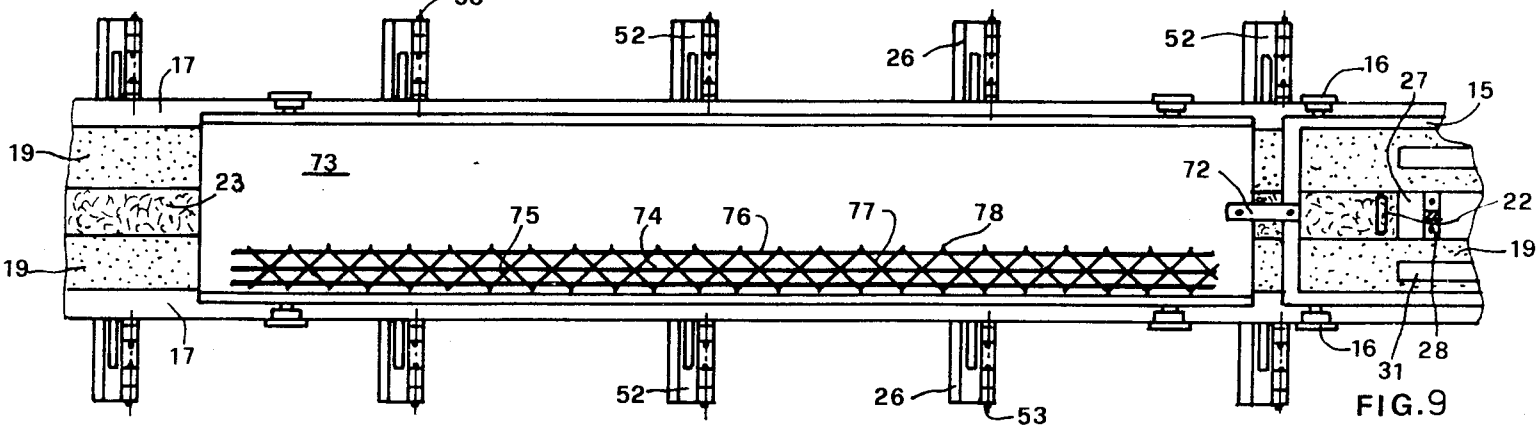
FIG. 9 is a plan view of FIG. 8.
Figure 10:
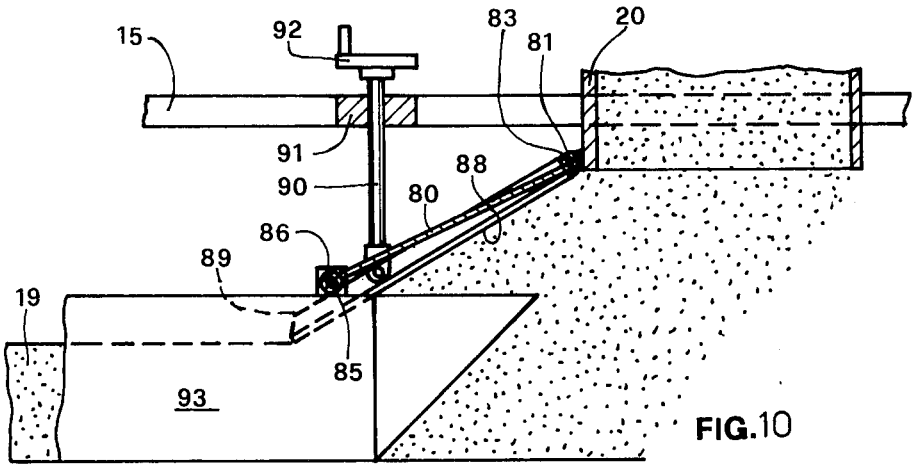
FIG. 10 is a detailed enlarged section through a modification of the inclined compacting shelf mobile to avoid replacing the central compacting element as the height of the required component increases.
Figure 11:
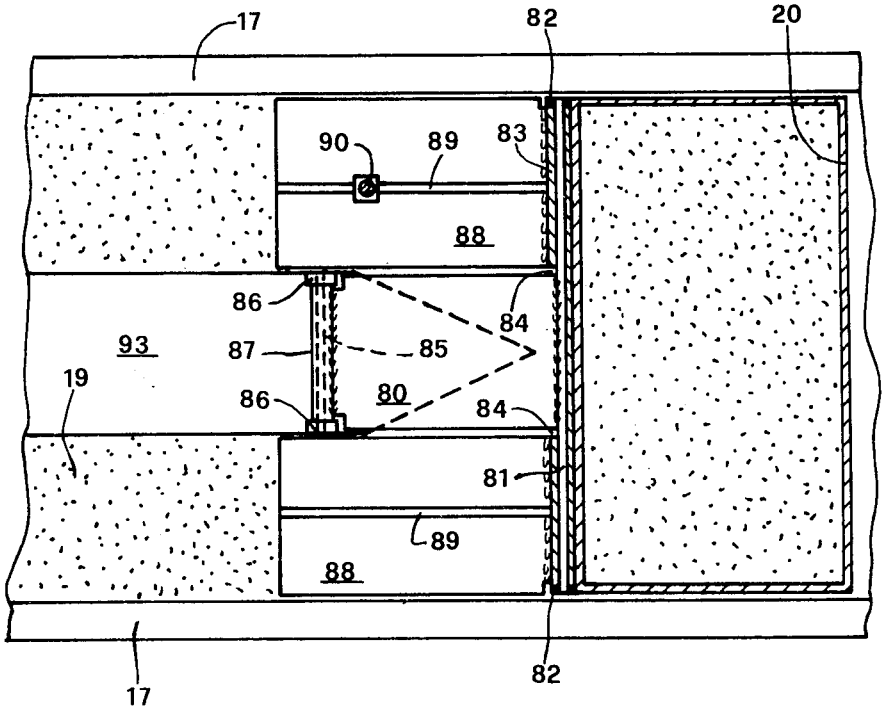
FIG. 11 is a plan view of FIG. 10.
Figure 12:
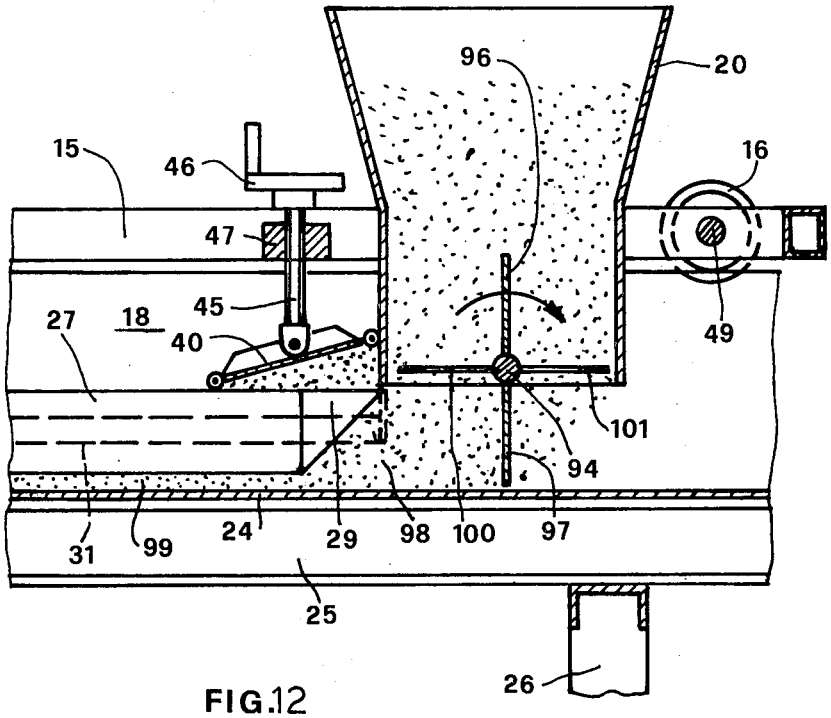
FIG. 12 is a partial enlarged side section through a modification of the feed and compacting device for the material for obtaining the component.
Figure 13:
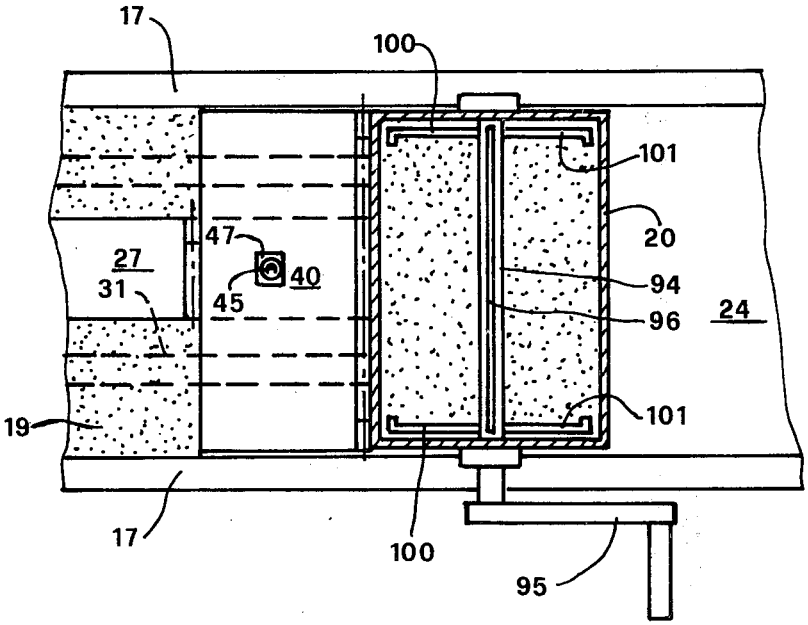
FIG. 13 is a partially sectional view from above of FIG. 12.
Figure 16:
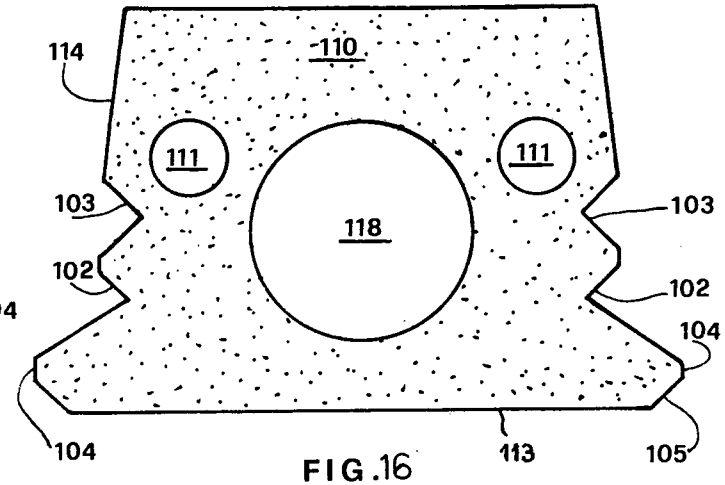
FIG. 16 is a cross-section through the slab or panel element manufactured with said machines when the body of the longitudinal form is circular in section and the rear cement hopper is missing, while the device of FIGS. 8 and 9 remains inactive.
Figure 17:
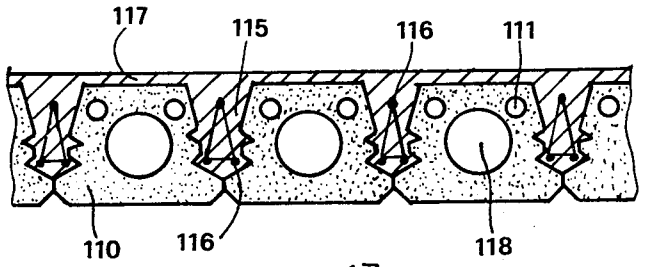
FIG. 17 is a section similar to that of FIG. 15, relative to the use of the element of FIG. 16.
Figure 14:
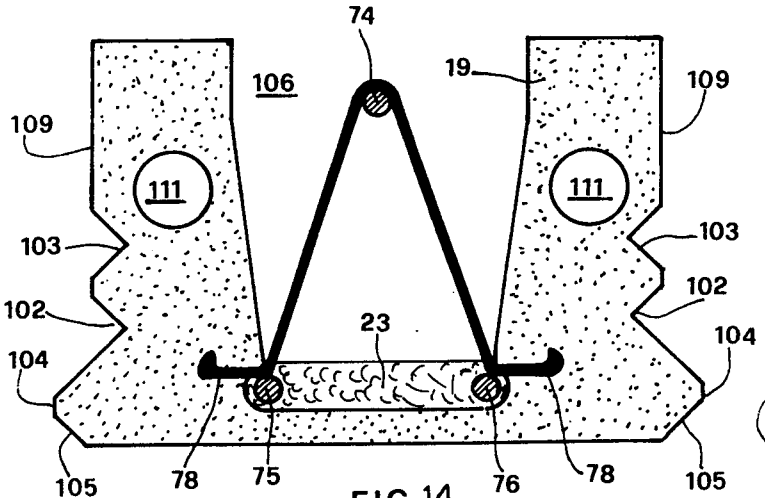
FIG. 14 is a cross-section through the slab element constituting the manufactured component, as manufactured by the machines previously illustrated.
Figure 15:
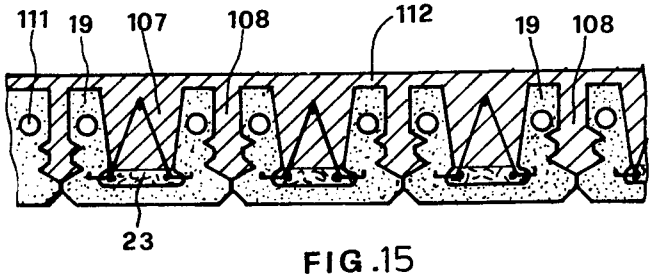
FIG. 15 is a partial cross-section through a floor slab made from the slab element of FIG. 14.

The casting of FIG. 16 is obtained by practically the same method as that used for the device of FIG. 4, excluding delivery from the hopper 22 and replacing the box 27 of rectangular, square, trapezoidal or mixed section by a box of circular section totally immersed in the polystyrene-cement paste mix, so giving a non-load bearing component 110, but with a particularly high level of lightness and insulation compared with traditional gauged bricks, and suitable for insertion into load bearing slab floors such as that of FIG. 17, during their erection. With regard to the manufacture of the brick 120, in short lengths or in more or less long continuous lengths, as in the left-hand side of FIG. 18, the method is similar to that used for manufacturing the non-load bearing slab elements 110 of FIG. 16, except that the wall 18 is replaced by a section 119.

Figure 18:
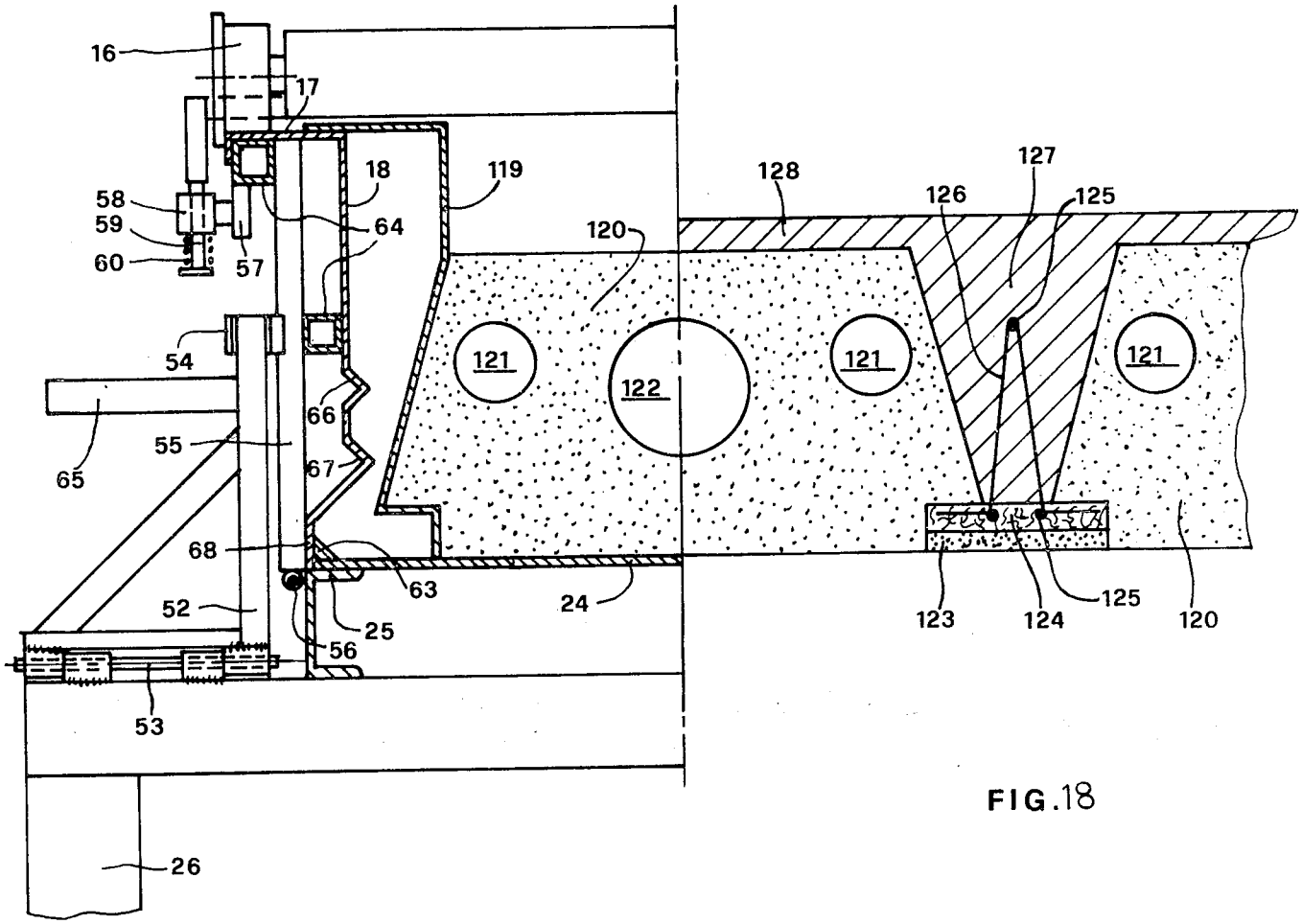
FIG. 18, the left-hand side, is a partial section through the plant of FIG. 7 when forming a gauged block or perforated element for a floor, with a mixture of polystyrene and cement, and the right-hand side is a section showing the use of such a gauged block with a load bearing beam, with its base prefabricated using a polystyrene-cement mixture to improve insulation, and completed by casting concrete in the plant, and then integrated with casting on site.
Figure 19:
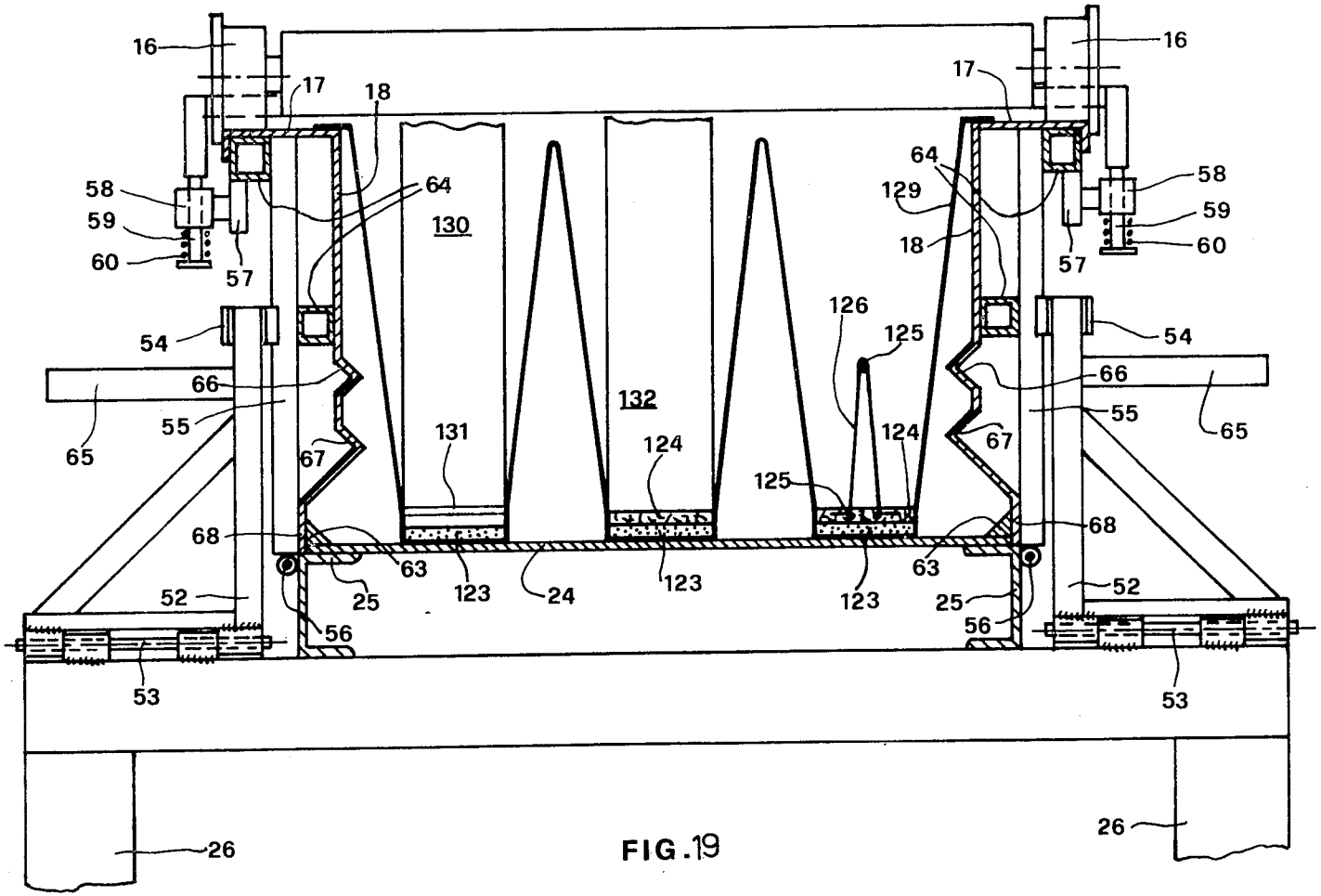
FIG. 19 is a partial section through the plant of FIG. 7 during production of the load bearing beams of FIG. 18.

Finally, for the manufacture of the beam 123, 124, 125, 126 in accordance with the right-hand side of FIG. 18, the device is set as in FIG. 19, which represents a transformation of the device of FIG. 4, obtained by inserting a crest-shaped plate 129 between the walls 18 and bottom 24 of the form, and replacing the body 27 and cylinders 31 by uprights 130 and 132, the first of which comprises a levelling plate 131.

Figure 20:
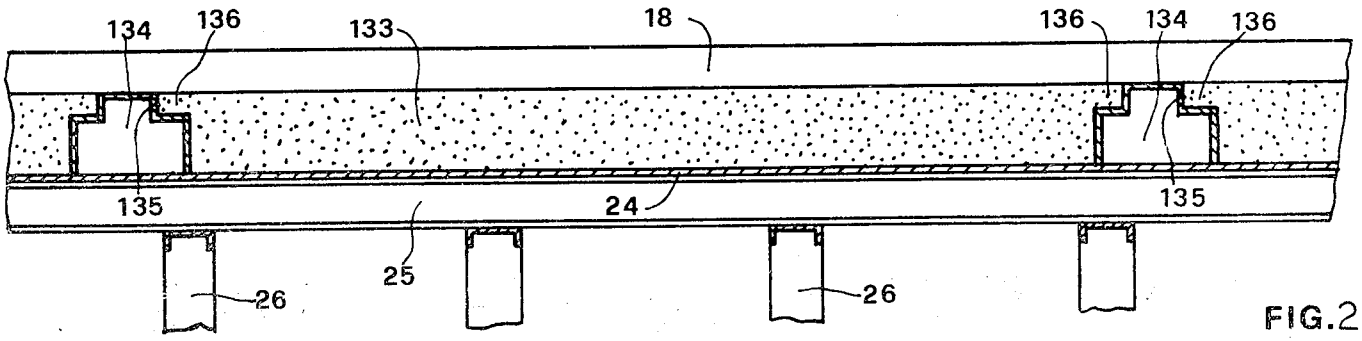
Figure 21:
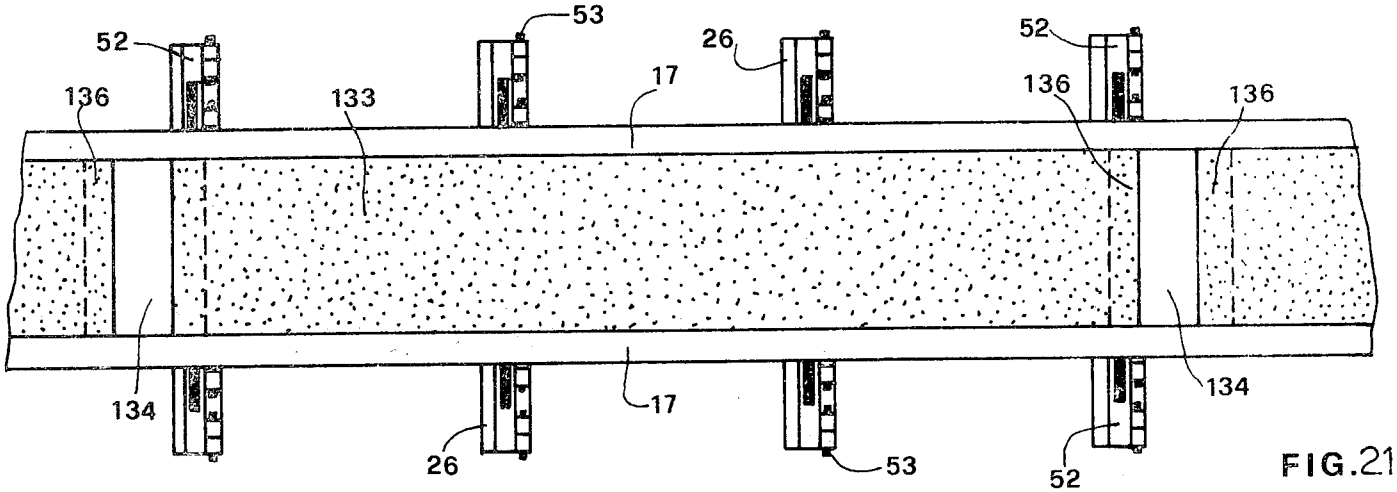
FIG. 21 is a plan view of FIG. 20.

Finally, for the manufacture of the short, or even very long and nearly continuous roofing units of FIGS. 20 and 21, the method is similar to that for forming the floor blocks 120 of FIG. 18, except that boxes 134, 135 are inserted along the form to create the erection, support or fixing edges 136 for the insulating roofing units 133. As an alternative to the movement of the frame 15 obtained by the motor 48, the movement of the frame may be obtained by the reaction of the expanded polystyrene-cement paste conveyed by the blades 96, 97 of the shaft 94, suitably rotated, under and to the side of the body 27, and contained upperly by 40 (FIGS. 12 and 13) and to the rear by an end of the form 18, 24, not shown, compacting being obtained at the rear by action against the end rear face of the box 27 to give a forward thrust which is transmitted by the frame 15 to the wheels 16, with the result that the frame automatically advances together with that connected to it. Instead of being driven by 48 or 94, the frame 15 could be driven by a tow rope, although less convenient.

Figure 22:
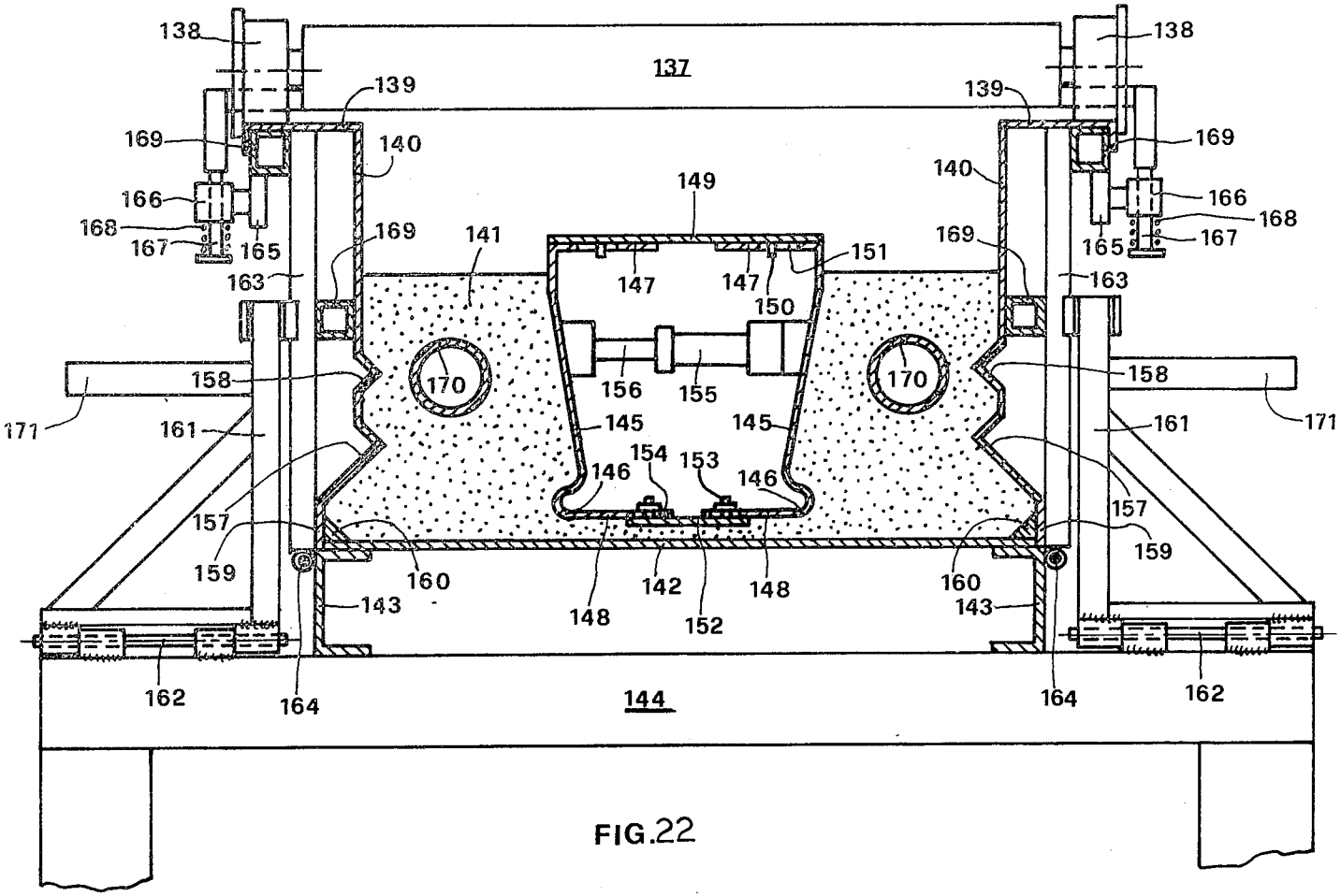
FIG. 22 is a cross-section through the plant with the non-mobile central body supported at the ends, and transversely adjustable.
Figure 23:
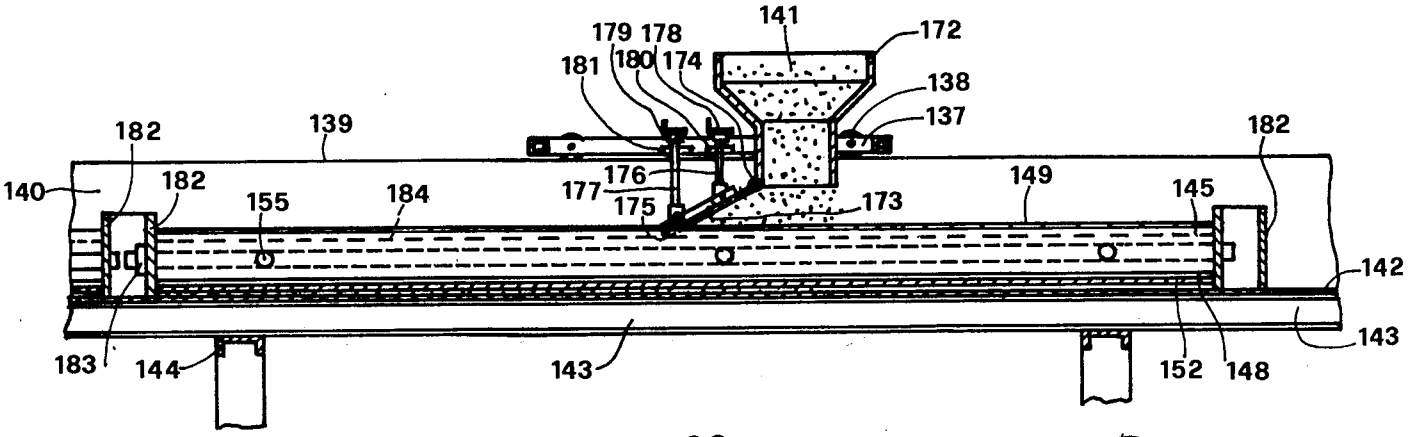
FIG. 23 is a reduced longitudinal section through FIG. 22 showing the device for compacting, smoothing, levelling and limiting the height of the component.
Figure 24:
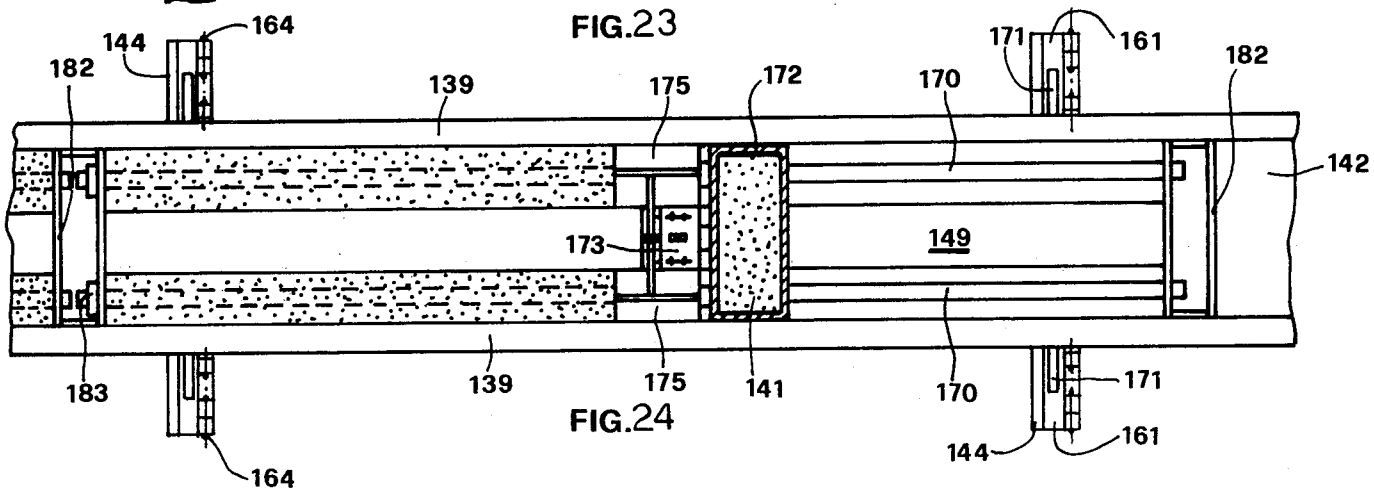
FIG. 24 is a plan view of FIG. 23.

The operation of the plant or machine in the case of said third application (FIG. 22 to FIG. 27) is as follows. In the case of FIGS. 22, 23, 24, the casting is carried out through 172 as the carriage 137, towed by a rope or winch, or by a motor installed on 137, runs along the guides 139. The upper bilateral surface 184 of the casting 141 is determined and smoothed by the rear edge of the inclined shelves 175, the inclination of which is set, on the basis of the required height for the casting 141, by the operating screw 177 by means of the handwheel 179. The contact between the back 149 of the central body and the rear lower edge of the inclined compacting shelf 173 is adjusted by the handwheel 174 and relative screw 176. 149, 145 and 152 are shaken out after the return of the rod 156 into the working cylinder 155, and the subsequent upward extraction, by any manual or other means, is done after deflating and withdrawing the elastic cylinders 170 or after withdrawing the fixed section cores which replace these cylinders.

Figure 25:
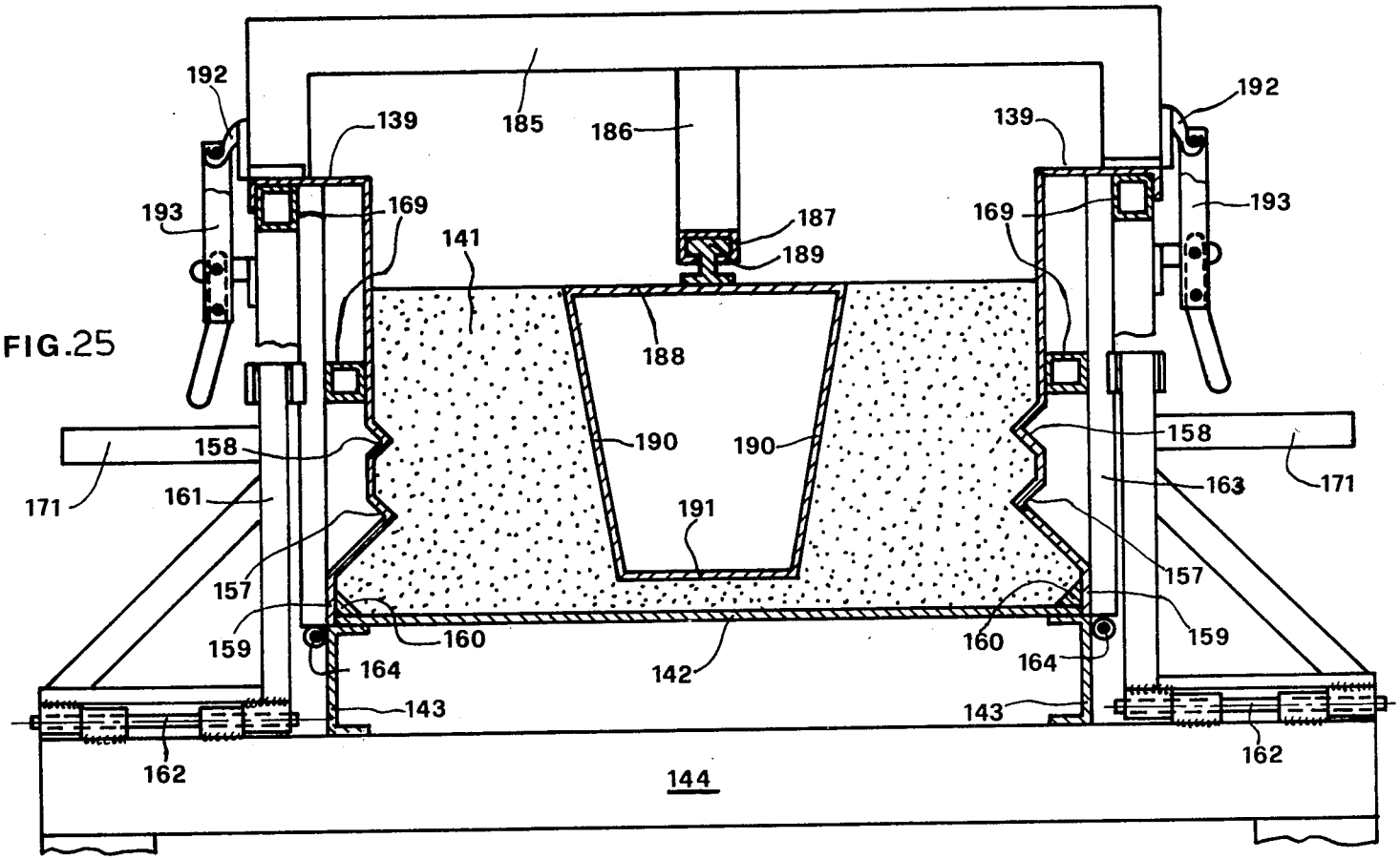
FIG. 25 is a cross-section through the plant with a non-adjustable central body, withdrawable longitudinally or vertically.
Figure 26:
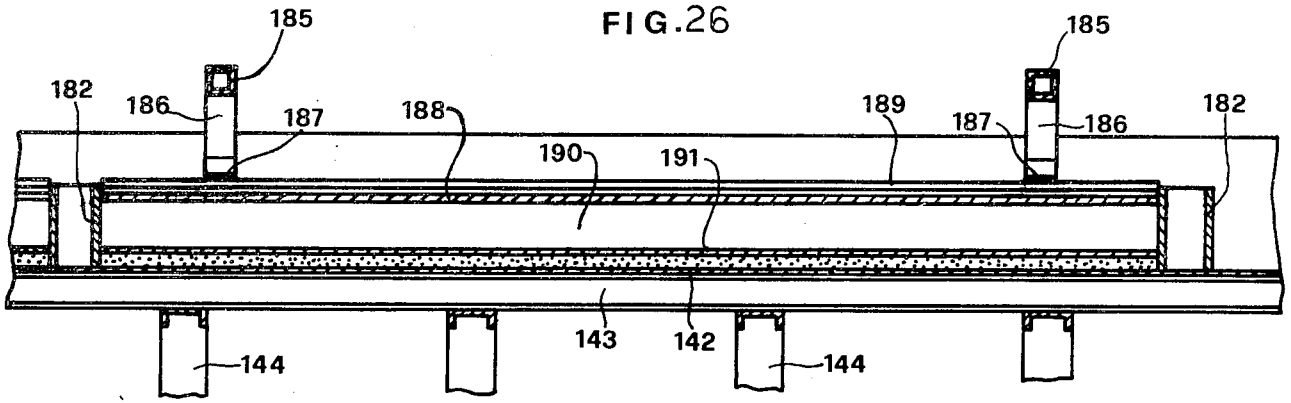
FIG. 26 is a reduced longitudinal section through FIG. 25.
Figure 27:
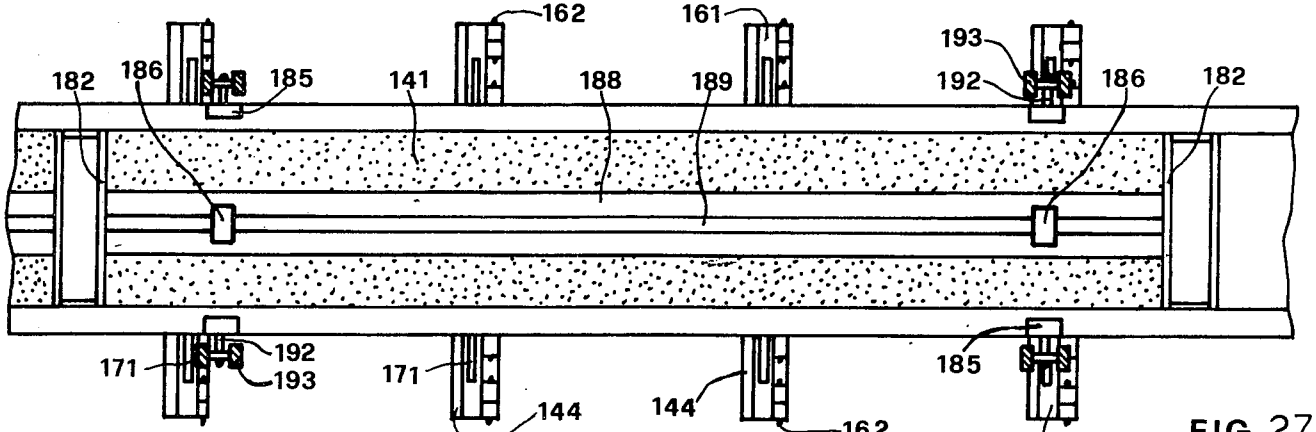
FIG. 27 is a plan view of FIG. 26.

In the case of FIGS. 25, 26, 27, after casting 141 with traditional means, the body 188, 189, 190, 191 is towed longitudinally to withdraw it, and to operate its end blades, not shown, so that they smooth and compact the upper surfaces of the casting 141 by their rear edge constituting the end of their profile inclined upwards in the direction of movement. The working cylinder 155 could be replaced by a pair of opposing screws threaded in opposite directions and coupled to an operating sleeve.

The operation of the plant or machine in the case of said fourth application (FIG. 28 to FIG. 35) is as follows. To obtain the manufactured component of FIG. 31, the front hopper 212 provided with a vibrator is continuously fed with a paste mix of expanded polystyrene and cement or other suitable material, the mix falling onto 211, while the shaft 198 driven by a motor, not shown, moves 194 on the rail 196 from left to right. As the box or hull 203 (of the same type as the hull 27 of FIG. 4) moves forward in the pasty mass, it distributes and compresses the mass lowerly and laterally because of the shape of its penetrating head, the inclined surface 216, its sides 248, the lateral surfaces 224, 226, the sides 208 and the bottom 211, to form the casting 228 (of the same type as 19 of FIG. 7), limited upperly and levelled by the rear ends of 12. The rear hopper 240, continuously fed with traditional concrete, then casts a slab 242 in the recessed cavity 243 created by the lower shaped part of 203, to imprison the lower rods of the reinforcement which is immediately inserted into the channel created by the hull 203.

In the meantime, the cylindrical elements 252, if present, advance with 194 to form lightening holes in the mass 228, while the grooves produced by 251 close automatically. The casting 228, suitably defined in length, rapidly hardens so that the manufactured component can be lifted after a short curing time from the bottom 211, noting that the sides 208 of the form have emerged together with the carriage from the region occupied by the casting 228, so as to leave it free laterally.

Figure 32:
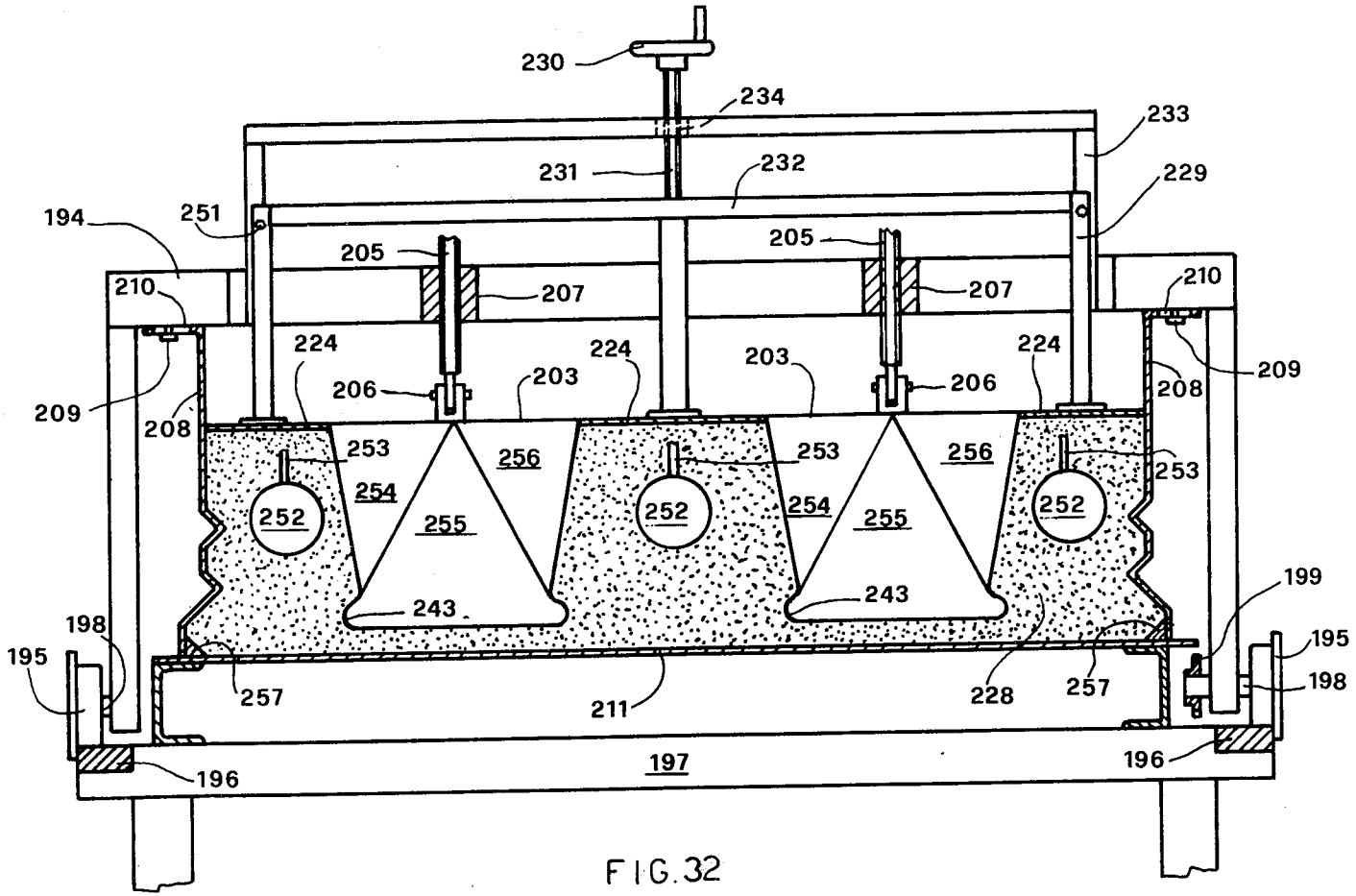
FIG. 32 is a vertical section similar to that of FIG. 31, but for the case of forming a double length floor slab element.

In the case of the double component of FIG. 32, the operation is completely analogous.

Figure 33:
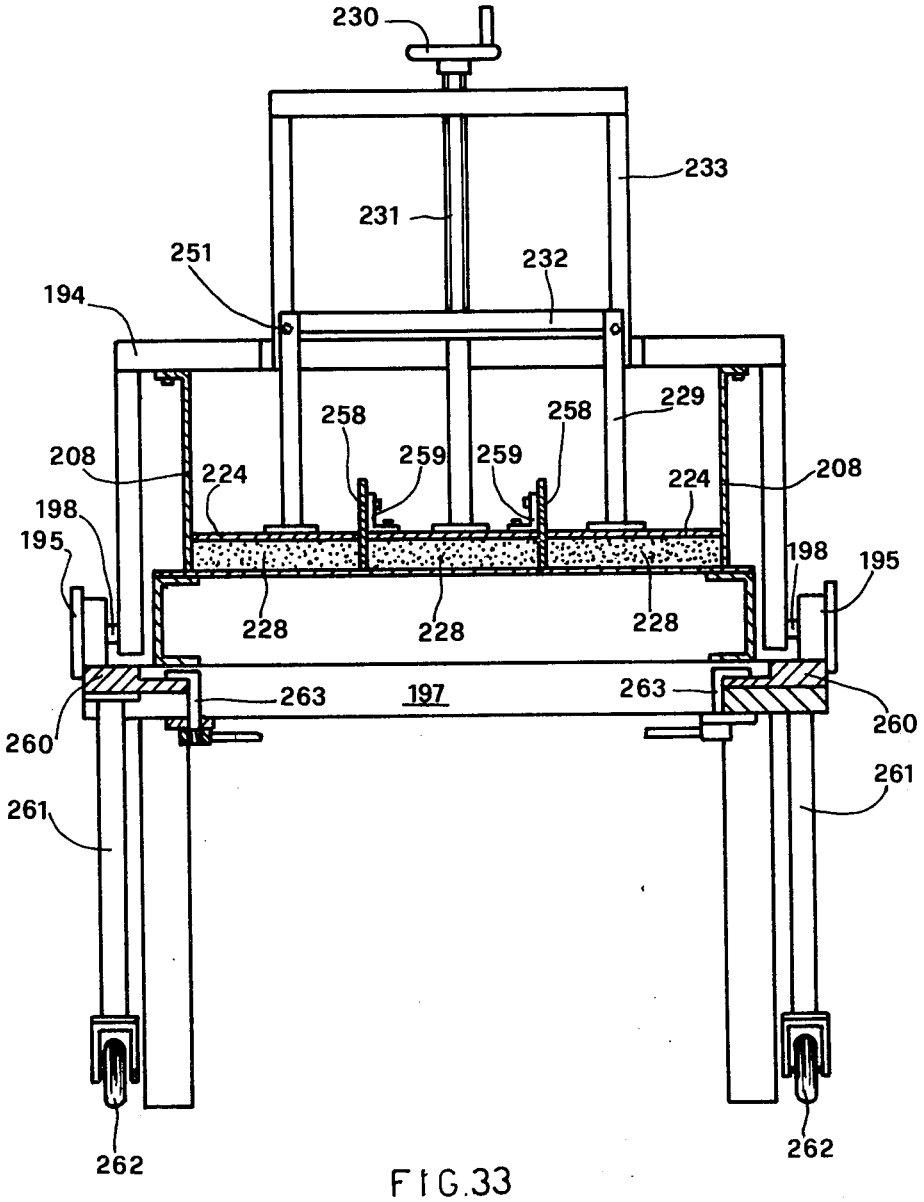
FIG. 33 is a vertical transverse section though a simplified device for manufacturing truss or wall panel elements side by side.

With regard to the shallow manufactured components of FIG. 33, which are obtained without the hull 203, without the hopper 240 and without cylindrical elements 250, the distributing and compacting operation is left entirely to 216, 224, 226, suitably adapted as necessary.

Figures 28, 29:
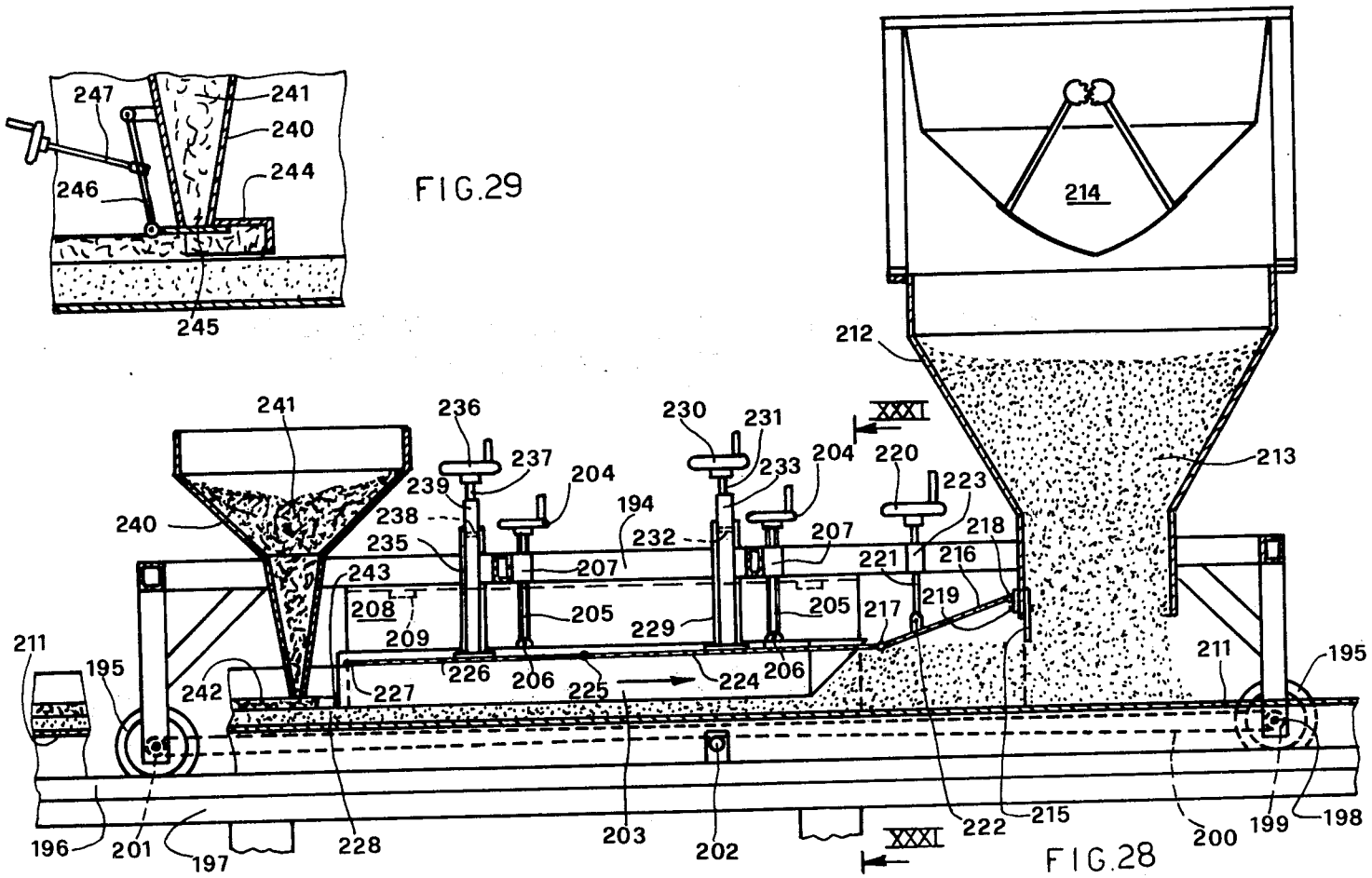
FIG. 28 is a vertical longitudinal section through the device with its sides installed on the slidable carriage, on rails which may be mobile.
FIG. 29 is a sectional enlarged detail of the delivery mouth of the hopper for traditional concrete.
Figure 30:
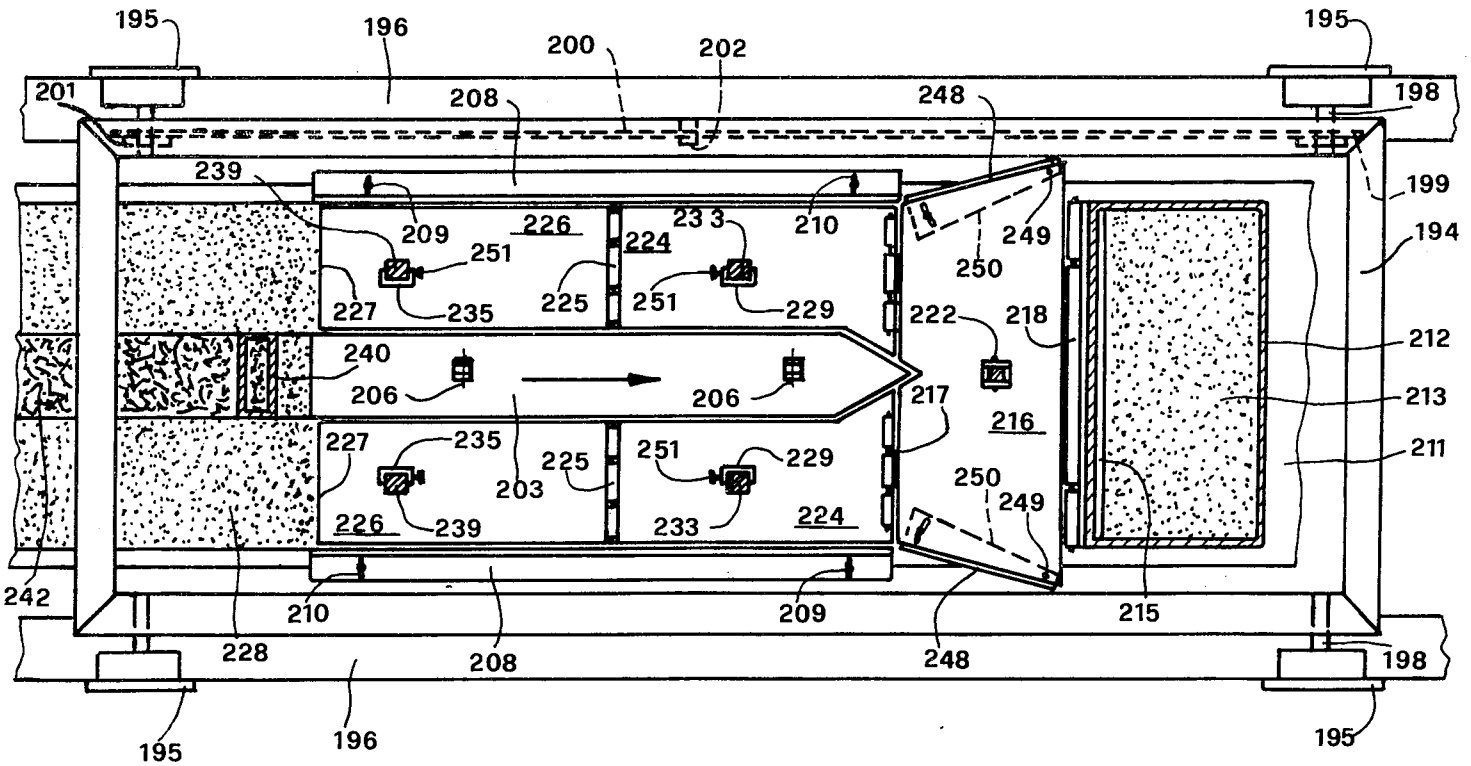
FIG. 30 is an incomplete partly sectional plan view of FIG. 28.
Figure 31:
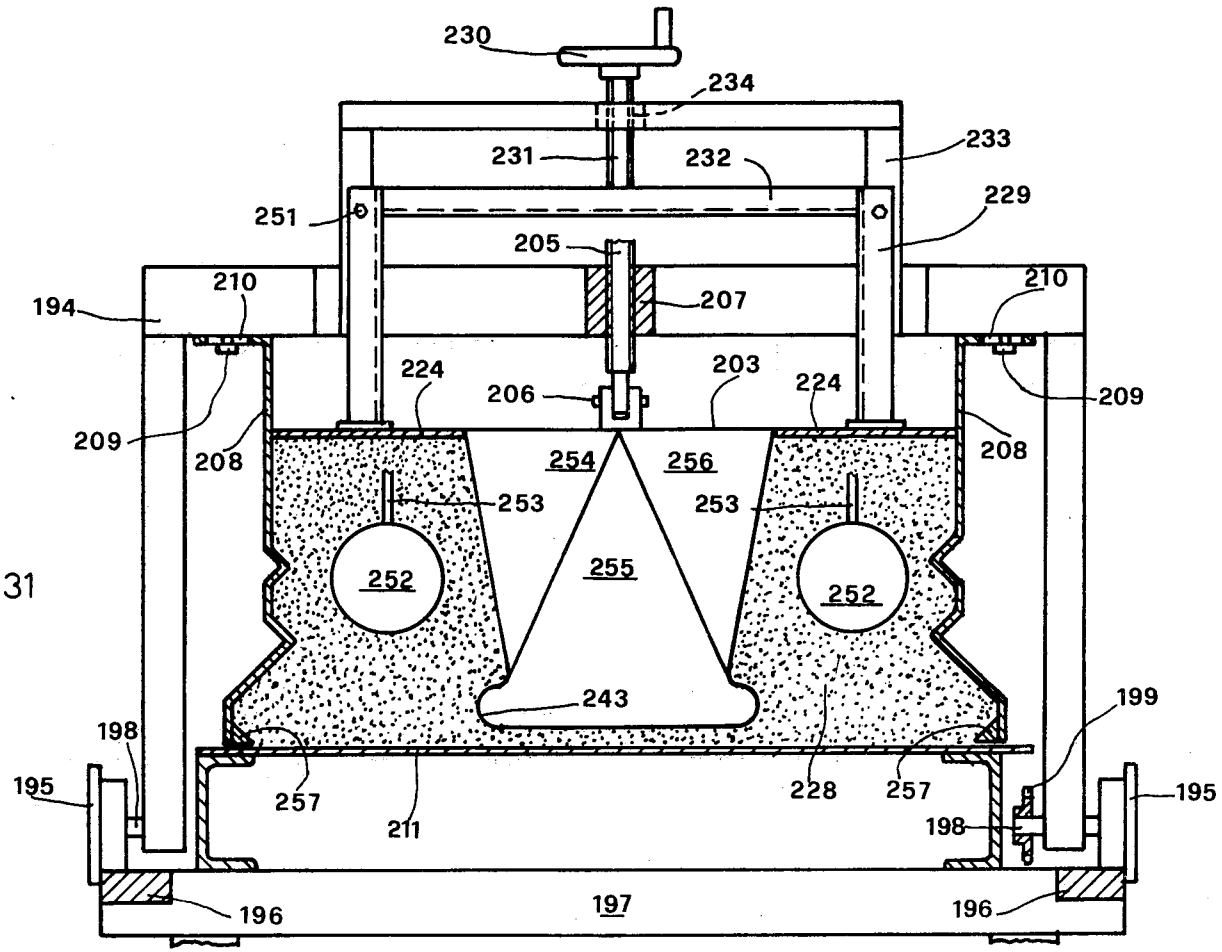
FIG. 31 is a transverse vertical section on the line XXXI—XXXI of FIG. 28.
Figure 34:
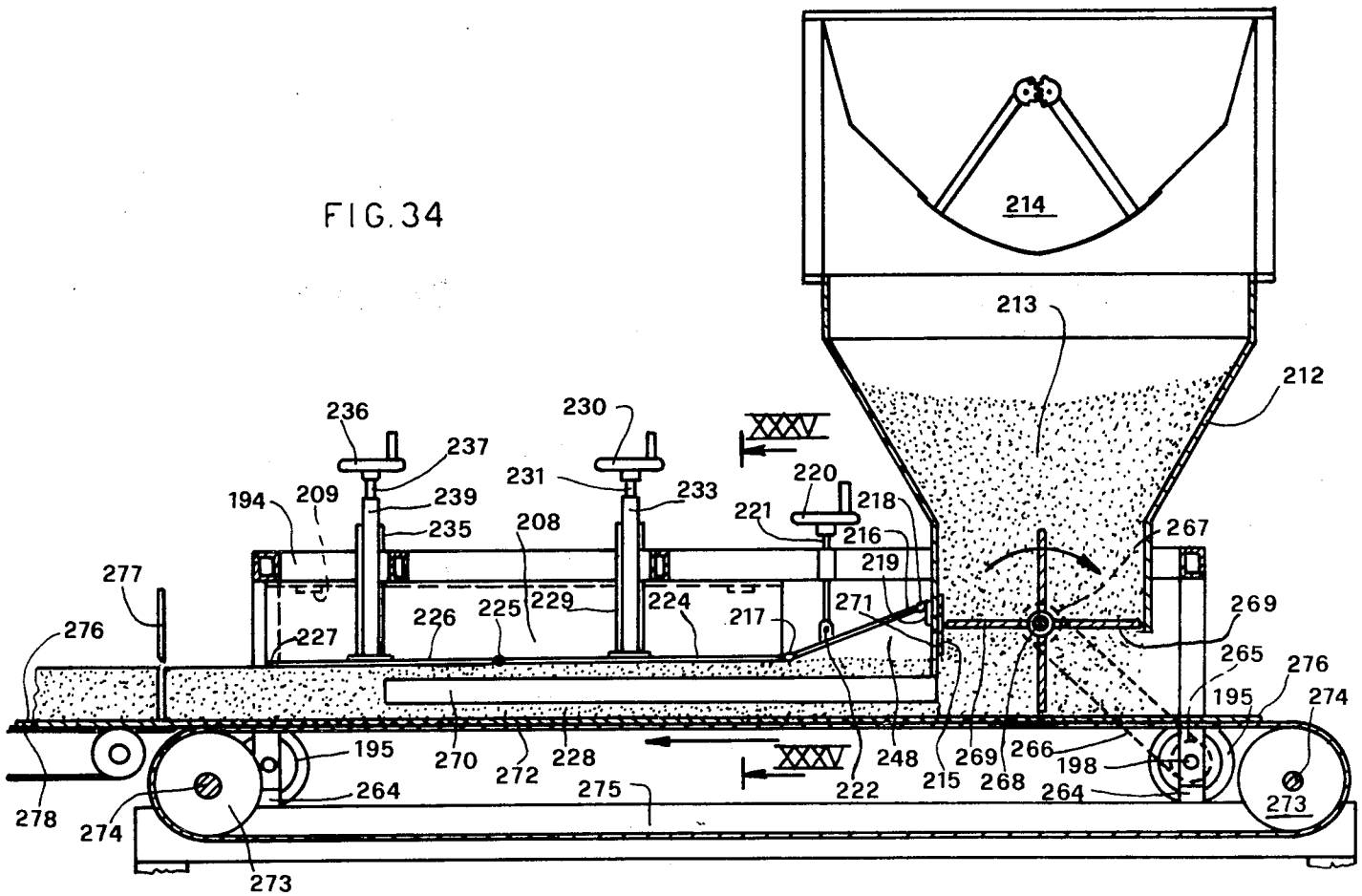
FIG. 34 is a longitudinal vertical section through the machine used as an extruder.
Figure 35:
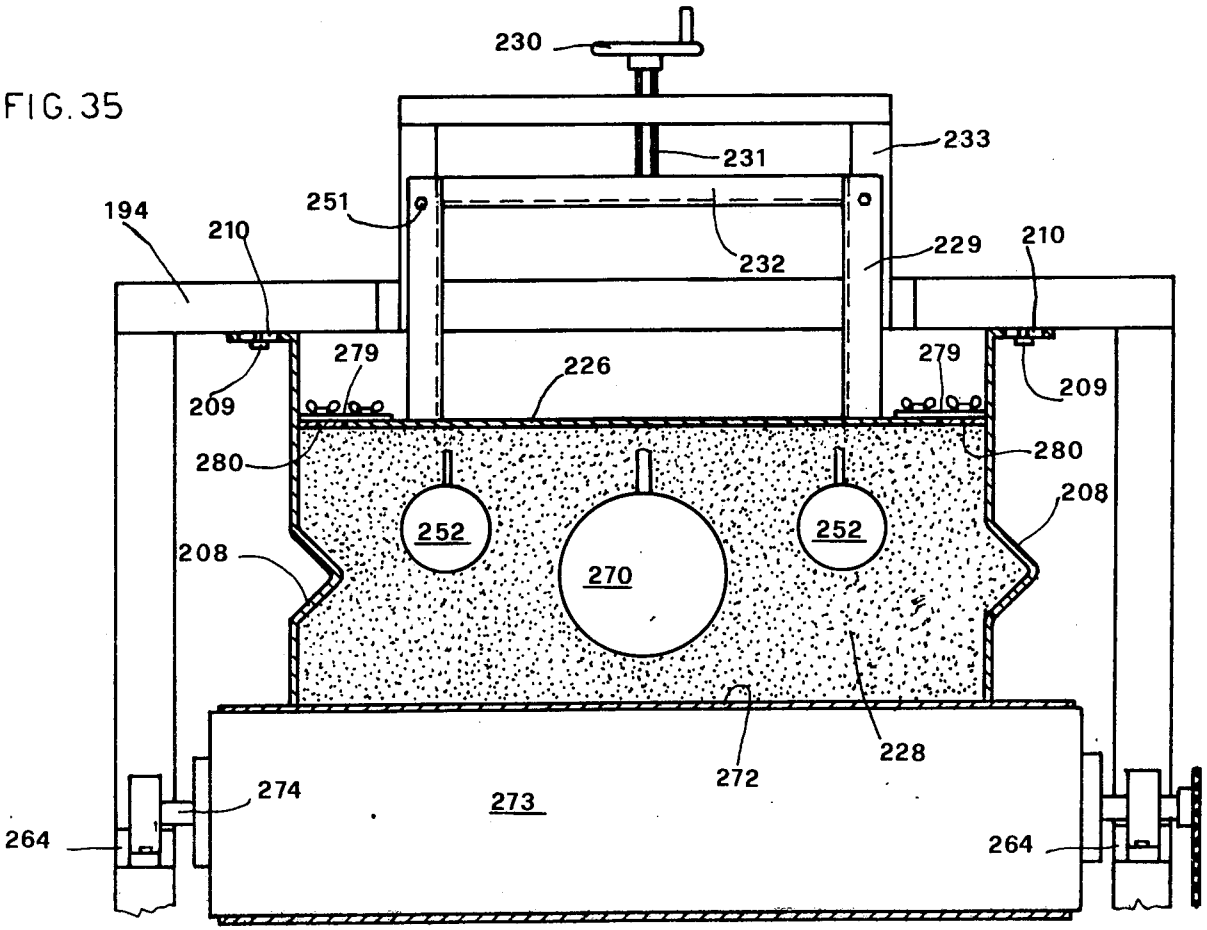
FIG. 35 is a vertical cross-section on the line XXXV—XXXV of FIG. 34.

With regard to the manufactured component of FIG. 35, obtainable either with the plant of FIG. 28 suitably adapted, or with the specific plant of FIG. 34, in this latter case it is obtained by operating the shaft 266 comprising the blades 267 by the chain 264, with the wheels 195 raised, the pasty mass 213 being thrust by the blades 267 backwards into the form 208, 274, limited upperly by the usual adjustable compacting, smoothing and limiting shelves 216, 224, 226, 227. The backward movement of said pasty mass is facilitated and made more rapid by the conveyor belt 270, which drags the bottom 274 of the form, divided into successive portions. The manufactured component is separated from the previous one by a cutting device 275. To prevent build-up of concrete at the outlet of the mouth of the rear hopper 240 and swelling of the casting 228, the mouth is provided at its front, at its top and at its sides with a box structure 244 for containing the emerging material, the mouth being obstructable by a plate 245 guided on two sides, hinged at the rear to a lever 246 upperly pivoted to the hopper body, and rotated to vary the opening and closure of the mouth by said plate, by means of an operating screw 247 with handwheel.

To obtain several components of fractional length from one large manufactured component, the lateral inclined shelves for compacting (compressing) and smoothing the top surface of the manufactured component, extending over the entire width without the hull, are provided at their rear with adjustable parallel vertical blades 258 descending to the bottom, of a number equal to the number of strips of longitudinal components to be obtained, less one.

To obtain components with several channels, two or more parallel hulls 203 are supported by operating screws 205 at the rear end of the carriage frame 194. To use a single pair of rails for several component forming lines for non-simultaneous operation, each rail (260 of FIG. 33) is divided into portions provided lowerly with uprights 261 comprising positionable wheels 262. Each said rail is removably fixed by clamps 263 to the base structure 197 of the plant. To avoid the need for weights for increasing the adherence of the carriage 194, 195 to the rail (196 or 260) and to give simultaneous greater self-sufficiency to the plant, an auxiliary reserve hopper 214 is installed above the front hopper 213.

With regard to the most important prefabrication method, this is substantially indicated in the second of said patent applications (40132 A/75). The castings of the most important prefabricated components designed to form load bearing or non-load bearing floors and walls after erection, are formed in a form ploughed by a longitudinal mobile hull provided with one or more parallel longitudinal bodies. The main casting, of expanded polystyrene-cement or the like, is made to the front of said hull in the direction of motion, and any secondary casting, or secondary castings if more than one, in several layers, are made to the rear of said hull. The manufactured component of FIGS. 1, 2, 3, without a cement slab at the bottom of the channel, may be manufactured by either the machine of FIG. 4, or with the machine of FIG. 28, or again with the machines of FIGS. 12 and 34, and also with the less advantageous machines of FIGS. 22 and 25. It should be further noted that the method of said second patent application is improved in the fourth application by the elimination of the long and costly reclinable lateral walls 18 of the form, replaced by the short economical walls 208 fixed to the carriage 194, 195, this being possible because during the slow motion of said carriage the casting consolidates sufficiently and has no longer any need, after passage of the carriage, to be contained by walls.

The manufactured components, the method and the machines may be modified within the scope of the inventive concept or technically equivalent concepts, without leaving the protection of the present invention.

What we claim is:

1. A prefabricated building panel formed of a mixture comprising light-weight expanded material, adhesive and cement, said panel comprising at least two longitudinally extending upstanding ribs separated by a channel adapted to be filled with concrete, longitudinally extending reinforcing elements disposed on the bottom of said channel, said reinforcing elements comprising means to enable said panel to be lifted after only brief curing, said means including upwardly projecting stirrup members and outwardly projecting appendices, said outwardly projecting appendices penetrating into the material of said longitudinally extending ribs adjacent the bottoms thereof.

2. A panel in accordance with claim 1, wherein said light-weight expanded material comprises granules of expanded polystyrene.

3. A panel in accordance with claim 1, wherein each of said upstanding ribs contains within the interior thereof a longitudinally extending insulating element of expanded polystyrene.

4. A panel in accordance with claim 1, having side walls so shaped to provide at the base thereof a lateral projection adapted to contact, in use, with a corresponding lateral projection of an adjacent panel or with an adjacent wall to provide a chamber thereabove adapted to be filled with concrete.

5. A panel in accordance with claim 1, wherein each of said upstanding ribs is provided with a longitudinally extending groove at the base of said channel so as to form undercuts in said ribs at the bottom of said channel, the lower portion of said channel to a height approximately equal to the top of said grooves being filled with cement or concrete to bury therewithin the lower parts of said reinforcing elements.

6. A panel in accordance with claim 5 having side walls so shaped to provide at the base thereof a lateral projection adapted to contact, in use, with a corresponding lateral projection of an adjacent panel or with an adjacent wall to provide a chamber thereabove adapted to be filled with concrete, said side walls further having longitudinally extending indentations therein.

* * * * *